US009132051B2

(12) United States Patent
Heil

(10) Patent No.: US 9,132,051 B2
(45) Date of Patent: Sep. 15, 2015

(54) PERSON SUPPORT APPARATUSES WITH EXERCISE FUNCTIONALITIES

(71) Applicant: Hill-Rom Services, Inc., Batesville, IN (US)

(72) Inventor: Thomas F. Heil, Batesville, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 0 days.

(21) Appl. No.: 14/155,794

(22) Filed: Jan. 15, 2014

(65) Prior Publication Data

US 2015/0196442 A1 Jul. 16, 2015

(51) Int. Cl.
*A47B 7/02* (2006.01)
*A61G 7/015* (2006.01)

(52) U.S. Cl.
CPC ..... *A61G 7/015* (2013.01)

(58) Field of Classification Search
CPC ..... A47C 19/04; A61H 2201/164; A61H 2203/0443
USPC ..... 5/618, 610, 612, 613, 614, 616
See application file for complete search history.

(56) References Cited

U.S. PATENT DOCUMENTS

| | | | | |
|---|---|---|---|---|
| 238,799 | A | | 3/1881 | Morgan |
| 1,018,757 | A | | 2/1912 | Grady |
| 1,561,979 | A | | 11/1925 | Gore |
| 1,735,569 | A | | 11/1929 | Gregory |
| 2,598,204 | A | | 5/1952 | Allen |
| 2,768,622 | A | | 10/1956 | Sanders |
| 3,220,022 | A | * | 11/1965 | Nelson ..... 5/618 |
| 3,455,295 | A | | 7/1969 | Kellogg |
| 3,527,202 | A | | 9/1970 | Donzelle |
| 3,589,358 | A | | 6/1971 | Megal |
| 3,741,200 | A | | 6/1973 | Morin |
| 3,759,252 | A | | 9/1973 | Berman |
| 3,760,801 | A | | 9/1973 | Borgeas |
| 3,821,953 | A | | 7/1974 | Mikan |
| 3,826,490 | A | | 7/1974 | Mossman |

(Continued)

FOREIGN PATENT DOCUMENTS

| | | | |
|---|---|---|---|
| CN | 2730342 | Y | 10/2005 |
| CN | 201044780 | Y | 4/2008 |

(Continued)

OTHER PUBLICATIONS

Non-Final Office Action dated Oct. 7, 2014 relating to U.S. Appl. No. 14/155,787, filed Jan. 15, 2014.

(Continued)

*Primary Examiner* — Timothy D Collins
*Assistant Examiner* — Richard G Davis
(74) *Attorney, Agent, or Firm* — Dinsmore & Shohl LLP

(57) ABSTRACT

Person support apparatuses with exercise functionalities are disclosed. In one embodiment, the person support apparatus may include a base frame and a primary support frame supported on the base frame. A carriage may be freely translatable at least between a head end of the primary support frame and a foot end of the primary support frame. A support surface may be supported on the carriage such that the support surface translates with the carriage. The support surface may include at least one support section which is collapsible in a length direction of the support surface. The at least one support section collapses as the carriage translates towards the foot end of the primary support frame.

34 Claims, 15 Drawing Sheets

(56) References Cited

U.S. PATENT DOCUMENTS

| | | | | |
|---|---|---|---|---|
| 3,868,734 | A | 3/1975 | Benoit et al. | |
| 3,887,180 | A | 6/1975 | Berman | |
| 3,892,404 | A | 7/1975 | Martucci | |
| 4,113,250 | A | 9/1978 | Davis | |
| 4,169,591 | A | 10/1979 | Douglas | |
| 4,378,791 | A | 4/1983 | Sarrell | |
| 4,383,684 | A | 5/1983 | Schliep | |
| 4,409,695 | A | 10/1983 | Johnston | |
| 4,444,178 | A | 4/1984 | Kuo | |
| 4,603,687 | A | 8/1986 | Greenwood | |
| 4,615,335 | A | 10/1986 | Searcy | |
| 4,620,704 | A | 11/1986 | Shifferaw | |
| 4,638,793 | A | 1/1987 | Therkorn | |
| 4,672,697 | A | 6/1987 | Schurch | |
| 4,798,197 | A | 1/1989 | Nippoldt et al. | |
| 4,825,852 | A | 5/1989 | Genovese et al. | |
| 4,847,929 | A | 7/1989 | Pupovic | |
| 4,867,143 | A | 9/1989 | Morin | |
| 4,890,604 | A | 1/1990 | Nelson | |
| 4,913,424 | A | 4/1990 | Pepin | |
| 4,925,184 | A | 5/1990 | McJunkin, Jr. et al. | |
| 4,928,957 | A | 5/1990 | Lanier et al. | |
| 4,995,378 | A | 2/1991 | Dyer et al. | |
| 5,005,829 | A | 4/1991 | Caruso | |
| 5,024,214 | A | 6/1991 | Hayes | |
| 5,098,089 | A | 3/1992 | Harrington et al. | |
| 5,107,822 | A | 4/1992 | Ohashi | |
| 5,125,884 | A | 6/1992 | Weber et al. | |
| 5,153,959 | A | 10/1992 | Fitzsimmons | |
| 5,169,363 | A | 12/1992 | Campanaro et al. | |
| 5,181,289 | A | 1/1993 | Kassai | |
| 5,207,628 | A | 5/1993 | Graham | |
| 5,263,913 | A | 11/1993 | Boren | |
| 5,402,544 | A | 4/1995 | Crawford et al. | |
| 5,413,543 | A | 5/1995 | Drago | |
| 5,454,126 | A * | 10/1995 | Foster et al. | 5/618 |
| 5,479,666 | A * | 1/1996 | Foster et al. | 5/624 |
| 5,551,937 | A | 9/1996 | Kwo | |
| 5,577,279 | A | 11/1996 | Foster et al. | |
| 5,601,519 | A | 2/1997 | Comereski | |
| 5,662,591 | A | 9/1997 | Peindl et al. | |
| 5,680,661 | A | 10/1997 | Foster et al. | |
| 5,715,548 | A | 2/1998 | Weismiller et al. | |
| 5,740,571 | A | 4/1998 | Tyra et al. | |
| 5,810,698 | A | 9/1998 | Hullett et al. | |
| 5,820,519 | A | 10/1998 | Slenker | |
| 5,851,166 | A | 12/1998 | Bernardson | |
| 5,860,941 | A | 1/1999 | Saringer et al. | |
| D405,132 | S | 2/1999 | Westfall et al. | |
| 5,885,197 | A | 3/1999 | Barton | |
| 5,938,571 | A | 8/1999 | Stevens | |
| 5,940,911 | A | 8/1999 | Wang | |
| 5,967,955 | A | 10/1999 | Westfall et al. | |
| 5,967,956 | A | 10/1999 | Teeter | |
| 6,212,714 | B1 * | 4/2001 | Allen et al. | 5/624 |
| 6,226,821 | B1 | 5/2001 | Heimbrock et al. | |
| 6,241,642 | B1 | 6/2001 | Slenker | |
| 6,243,897 | B1 | 6/2001 | Sumiya | |
| 6,270,445 | B1 | 8/2001 | Dean, Jr. et al. | |
| 6,371,894 | B1 | 4/2002 | Hill | |
| 6,446,287 | B2 | 9/2002 | Borders | |
| 6,464,296 | B1 | 10/2002 | Sumner | |
| 6,611,979 | B2 * | 9/2003 | Welling et al. | 5/624 |
| 6,645,130 | B2 | 11/2003 | Webber | |
| 6,862,762 | B1 | 3/2005 | Johnson et al. | |
| 6,910,236 | B2 * | 6/2005 | Rene | 5/624 |
| 7,181,793 | B2 | 2/2007 | Lee | |
| 7,416,518 | B2 | 8/2008 | Cardinale | |
| 7,426,760 | B2 | 9/2008 | Vrzalik | |
| 7,481,751 | B1 | 1/2009 | Arnold | |
| 7,597,656 | B2 | 10/2009 | Trees | |
| 7,744,546 | B2 | 6/2010 | Lee | |
| 7,874,971 | B2 | 1/2011 | Reyes | |
| 7,883,444 | B1 | 2/2011 | Wu | |
| 7,967,736 | B2 | 6/2011 | D'Silva et al. | |
| 8,012,073 | B2 | 9/2011 | Barnett | |
| 8,249,714 | B1 | 8/2012 | Hartman et al. | |
| 8,640,285 | B2 | 2/2014 | Heimbrock et al. | |
| 2004/0043876 | A1 | 3/2004 | Craciunescu | |
| 2004/0221391 | A1 | 11/2004 | Allen et al. | |
| 2007/0180621 | A1 | 8/2007 | Turner et al. | |
| 2007/0203434 | A1 * | 8/2007 | Namgung et al. | 601/24 |
| 2008/0289108 | A1 | 11/2008 | Menkedick et al. | |
| 2010/0005591 | A1 | 1/2010 | Manouchehri | |
| 2010/0313358 | A1 | 12/2010 | Poyet | |
| 2010/0313897 | A1 | 12/2010 | Schaeffer | |
| 2011/0004996 | A1 | 1/2011 | Ryou et al. | |
| 2011/0143898 | A1 * | 6/2011 | Trees | 482/142 |
| 2011/0231997 | A1 | 9/2011 | Turner et al. | |
| 2011/0251022 | A1 | 10/2011 | Lee | |
| 2012/0066832 | A1 | 3/2012 | Poulos et al. | |
| 2012/0073053 | A1 | 3/2012 | Turner et al. | |
| 2012/0079655 | A1 | 4/2012 | Tekulve | |
| 2012/0117730 | A1 | 5/2012 | Lemire et al. | |

FOREIGN PATENT DOCUMENTS

| | | | |
|---|---|---|---|
| DE | 3736847 | A1 | 5/1989 |
| GB | 358890 | | 10/1931 |
| JP | 3692286 | B2 | 9/2005 |
| JP | 2007082877 | A | 4/2007 |
| KR | 100621350 | B1 | 9/2006 |
| KR | 2009094588 | A | 9/2009 |
| KR | 100942968 | B1 | 2/2010 |
| WO | 9807402 | A | 2/1998 |
| WO | 2009154372 | A | 12/2009 |
| WO | 2010057873 | A1 | 5/2010 |

OTHER PUBLICATIONS

Non-Final Office Action dated Mar. 18, 2013; U.S. Appl. No. 12/959,251, filed Dec. 2, 2010.

Notice of Allowance dated Jul. 17, 2013; U.S. Appl. No. 12/959,251, filed Dec. 2, 2010.

International Search Report and Written Opinion of the International Searching Authority mailed Aug. 23, 2011; PCT/US2010/058786 filed Dec. 2, 2010.

International Search Report & Written Opinion mailed Mar. 3, 2014 relating to PCT/US2013/070326 filed Nov. 15, 2013; (10 Pages).

International Search Report & Written Opinion mailed Mar. 16, 2015 relating to PCT/US2014/070873 filed Dec. 17, 2014.

Non-Final Office Action mailed Feb. 25, 2015 relating to U.S. Appl. No. 14/039,927, filed Sep. 27, 2013.

Notice of Allowance mailed Jan. 20, 2015 relating to U.S. Appl. No. 14/155,787, filed Jan. 15, 2014.

* cited by examiner

PERSON SUPPORT APPARATUSES WITH EXERCISE FUNCTIONALITIES

BACKGROUND

1. Field

The present specification generally relates to person support apparatuses and, more specifically, to person support apparatuses which include a slidable carriage and a collapsible support surface to facilitate performing exercises with the person support apparatus.

2. Technical Background

Recent medical advances have allowed more patients to survive serious injuries or disease processes than ever before. Unfortunately, the period of bed rest required for recovery often leads to severe deterioration of muscle strength and a corresponding inability of the patient to support full body weight upon standing. It is challenging for rehabilitation specialists to help these patients regain the ability to stand and begin ambulation, and the challenge is especially great for obese patients. A common technique in conventional practice is to summon as many colleagues as practical to lift and maneuver the weakened patient to a standing position while he or she attempts to bear full weight through the lower extremities. This technique is not only dangerous, because of the risk of a fall, but it is also psychologically degrading for the patient as the activity reinforces the patient's dependence on others.

Hospital beds have evolved from conventional beds that lie flat to beds that convert into a chair position, allowing patients to begin standing from the foot of the bed. Examples of these beds are the Total Care bed by Hill-Rom (Batesville, Ind.) and the BariKare bed by Kinetic Concepts Incorporated (San Antonio, Tex.). The sitting position does not improve a patient's leg strength and does little for preparing a patient for upright standing. Patients are still required to be lifted by hospital staff as the patient's leg muscles do not have adequate strength to support their weight.

Accordingly, a need exists for alternative person support apparatuses, such as hospital beds and/or patient care beds, which enable a person to perform rehabilitation exercises.

SUMMARY

According to one embodiment, a person support apparatus may include a base frame and a primary support frame supported on the base frame. A carriage may be freely translatable at least between a head end of the primary support frame and a foot end of the primary support frame. A support surface may be supported on the carriage such that the support surface translates with the carriage. The support surface may include at least one support section which is collapsible in a length direction of the support surface. The at least one support section may collapse as the carriage translates towards the foot end of the primary support frame.

According to another embodiment, a person support apparatus may include a base frame and a primary support frame supported on the base frame such that the primary support frame is tiltable with respect to the base frame. An extendable foot section may be pivotally coupled to the primary support frame. The extendable foot section may have an extended position and at least one retracted position with respect to the primary support frame. A carriage may be freely translatable at least between a head end of the primary support frame and a foot end of the primary support frame. A support surface may be supported on the carriage such that the support surface translates with the carriage. The support surface may include a lower support section having at least one air bladder. The person support apparatus may have an exercise configuration in which the at least one air bladder is vented such that the at least one air bladder collapses as the carriage translates towards the foot end of the primary support frame.

Additional features and advantages of the embodiments described herein will be set forth in the detailed description which follows, and in part will be readily apparent to those skilled in the art from that description or recognized by practicing the embodiments described herein, including the detailed description which follows, the claims, as well as the appended drawings.

It is to be understood that both the foregoing general description and the following detailed description describe various embodiments and are intended to provide an overview or framework for understanding the nature and character of the claimed subject matter. The accompanying drawings are included to provide a further understanding of the various embodiments, and are incorporated into and constitute a part of this specification. The drawings illustrate the various embodiments described herein, and together with the description serve to explain the principles and operations of the claimed subject matter.

DETAILED DESCRIPTION

Figure 1A:
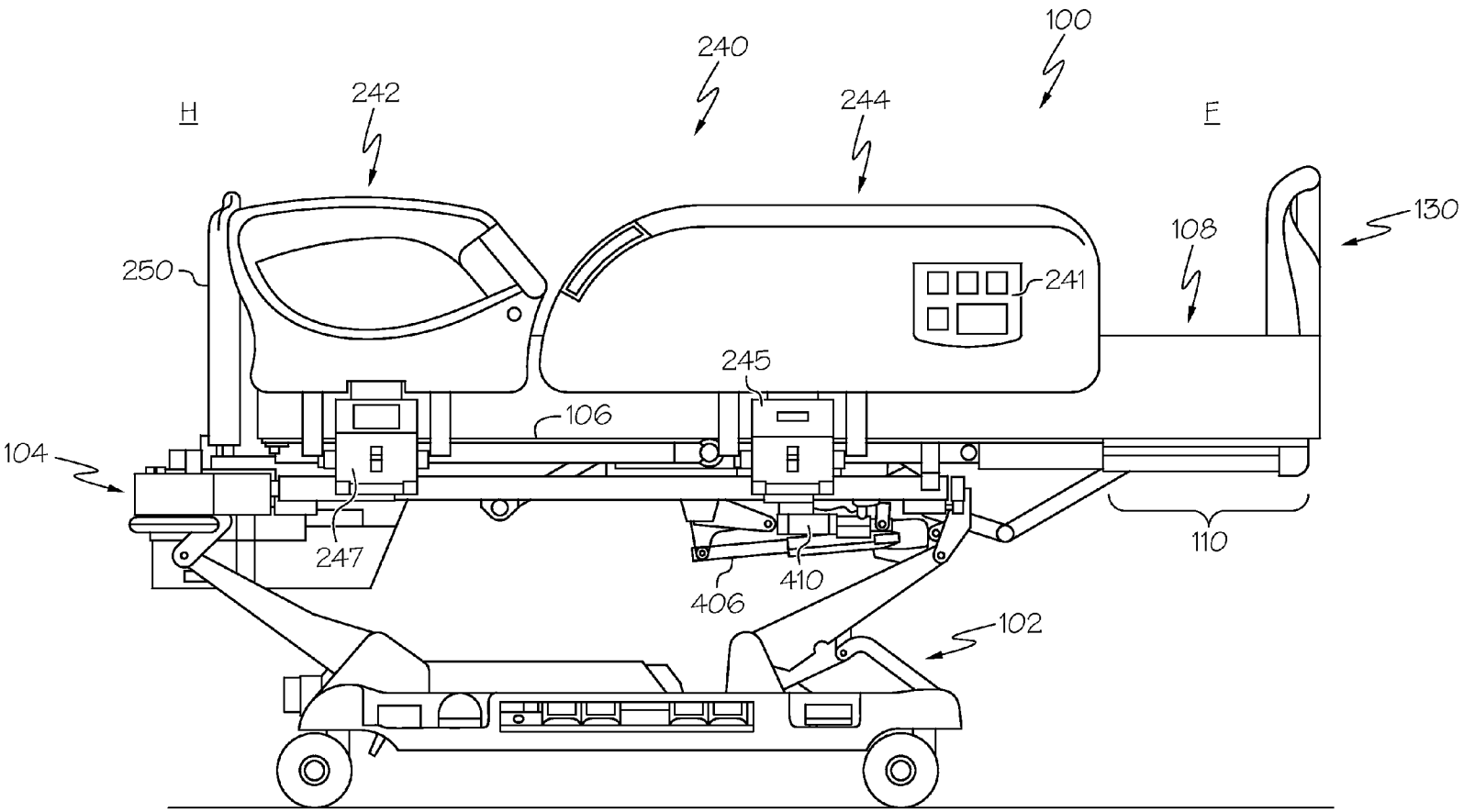
FIG. 1A depicts a side view of a person support apparatus according to one or more embodiments shown and described herein.
Figure 1B:
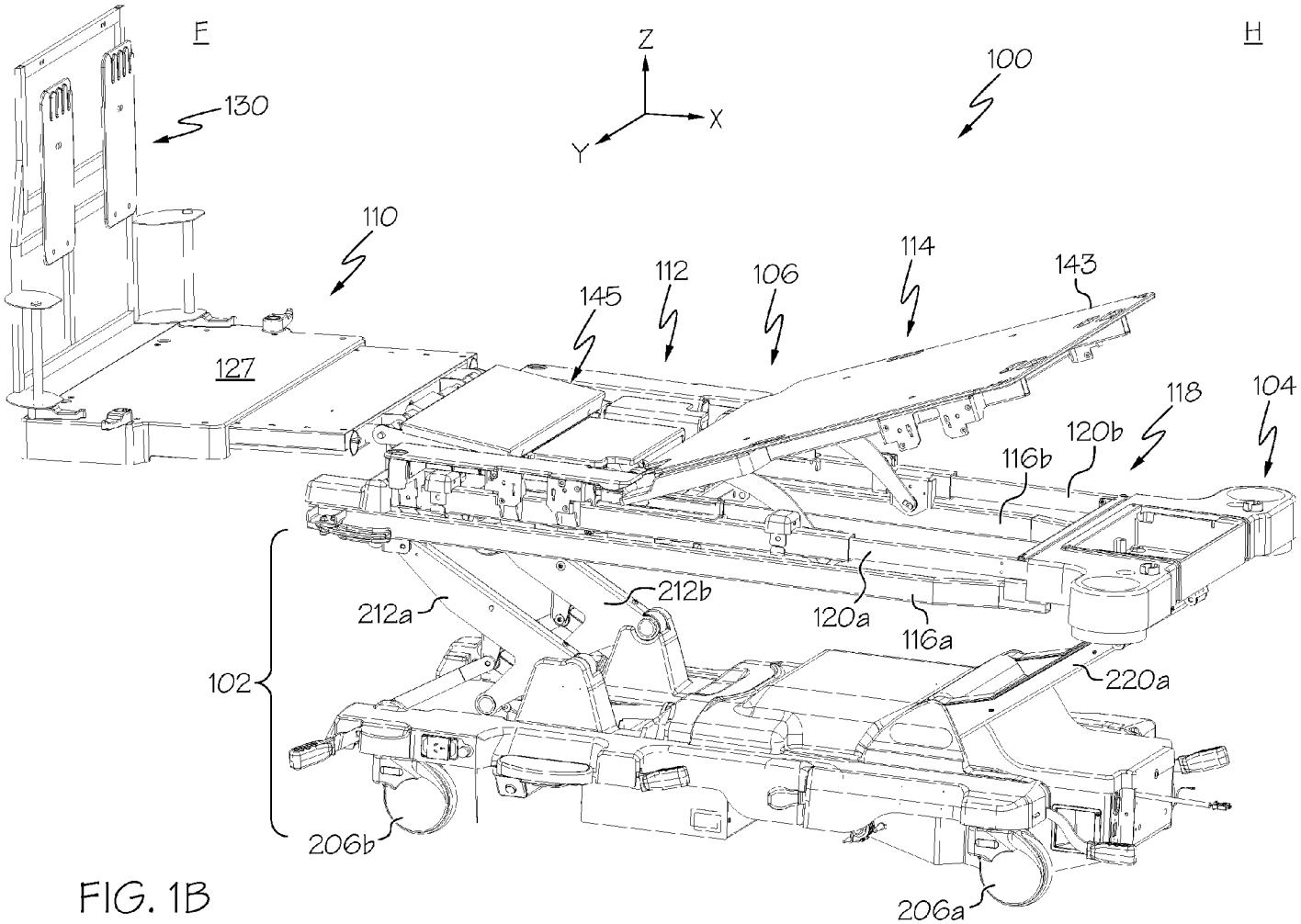
FIG. 1B depicts a perspective view of the base frame, primary support frame, and carriage of the person support apparatus of FIG. 1A.

Reference will now be made in detail to embodiments of person support apparatuses with exercise functionalities, examples of which are illustrated in the accompanying drawings. Whenever possible, the same reference numerals will be used throughout the drawings to refer to the same or like parts. One embodiment of a person support apparatus is depicted in FIGS. 1A and 1B. The person support apparatus may include a base frame and a primary support frame supported on the base frame. A carriage may be freely translatable at least between a head end of the primary support frame and a foot end of the primary support frame. A support surface may be supported on the carriage such that the support surface translates with the carriage. The support surface may include at least one support section which is collapsible in a length direction of the support surface. The at least one support section collapses as the carriage translates towards the foot end of the primary support frame. Person support apparatuses with sliding carriages and compressible support sections will be described in more detail herein with specific reference to the appended drawings.

Referring now to FIGS. 1A and 1B, a person support apparatus 100 is schematically depicted according to one or more embodiments shown and described herein. The person support apparatus 100 may be, for example, a hospital bed, a stretcher, a patient lift, a chair, an operating table, or similar support apparatuses commonly found in hospitals, nursing homes, rehabilitation centers or the like. The person support apparatus 100 generally includes a base frame 102, a primary support frame 104 supported on the base frame 102, and a carriage 106 supported on the primary support frame 104. The carriage is translatable (for example, by sliding) relative to the base frame 102 and the primary support frame 104 between a head end H and a foot end F of the person support apparatus 100. The primary support frame 104 may further include an extendable foot section 110 pivotally coupled to a foot end F of the primary support frame 104. The person support apparatus 100 also includes a support surface 108 (FIG. 1A) which may be supported on the primary support frame 104. At least a portion of the support surface 108 is positioned on the carriage 106 and, as such, is translatable with the carriage 106 relative to the base frame 102 and the primary support frame 104. As will be described in more detail herein, the support surface includes at least one support section which is selectively collapsible in a length direction of the support surface such that, as the carriage translates towards the foot end F of the primary support frame 104, the at least one support section collapses, thereby allowing the carriage to translate towards the foot end F of the person support apparatus.

The person support apparatus 100 may further include side rails 240 (one depicted in FIG. 1A), a footboard 130, and a headboard 250. The side rails 240, headboard 250, and footboard 130 are supported by the primary support frame 104, as depicted in FIG. 1A. In some embodiments, the side rails 240 may include multiple sections. For example, in some embodiments the side rails 240 may each include a head side rail 242, positioned adjacent to the head end H of the person support apparatus 100, and an intermediate side rail 244 positioned between the head side rail 242 and the foot end F of the person support apparatus. In embodiments, the side rails 240 may include one or more user interfaces 241 for controlling the various functions of the person support apparatus 100.

Still referring to FIG. 1A, in some embodiments, the head side rail 242 includes a hinge assembly 247, as shown in FIG. 1A. The hinge assembly 247 is configured to movably couple the head side rail 242 to the primary support frame 104 and move the head side rail 242 between a deployed position (depicted in FIG. 1A) and a stowed position (not depicted). When the head side rail 242 is in the deployed position, at least a portion of the head side rail 242 is positioned above the support surface 108. When the head side rail 242 is in the stowed position, the head side rail 242 is positioned below at least the support surface 108 and directly adjacent to the base frame 102. In some embodiments, the hinge assembly 247 includes a locking mechanism (not shown) that is configured to maintain the head side rail 242 in the deployed position and/or the stowed position.

The intermediate side rail 244 may also include a hinge assembly 245 as shown in FIG. 1A. The hinge assembly 245 is configured to move the intermediate side rail 244 between a deployed position and a stowed position. When the intermediate side rail 244 is in the deployed position, at least a portion of the intermediate side rail 244 is positioned above the support surface 108. When the intermediate side rail 244 is in the stowed position, the intermediate side rail 244 is positioned below at least the support surface 108 and directly adjacent to the base frame 102. In some embodiments, the hinge assembly 245 includes a locking mechanism (not shown) that is configured to maintain the intermediate side rail 244 in the deployed position and/or the stowed position.

In the embodiments described herein, the lateral spacing between the side rails of the person support apparatus 100 may be adjusted to accommodate different size patients. For example, in one embodiment, at least one of the side rails 240 may be coupled to a lateral track which allows the side rail to be selectively positioned in a width-wise direction of the person support apparatus 100.

Figure 2:
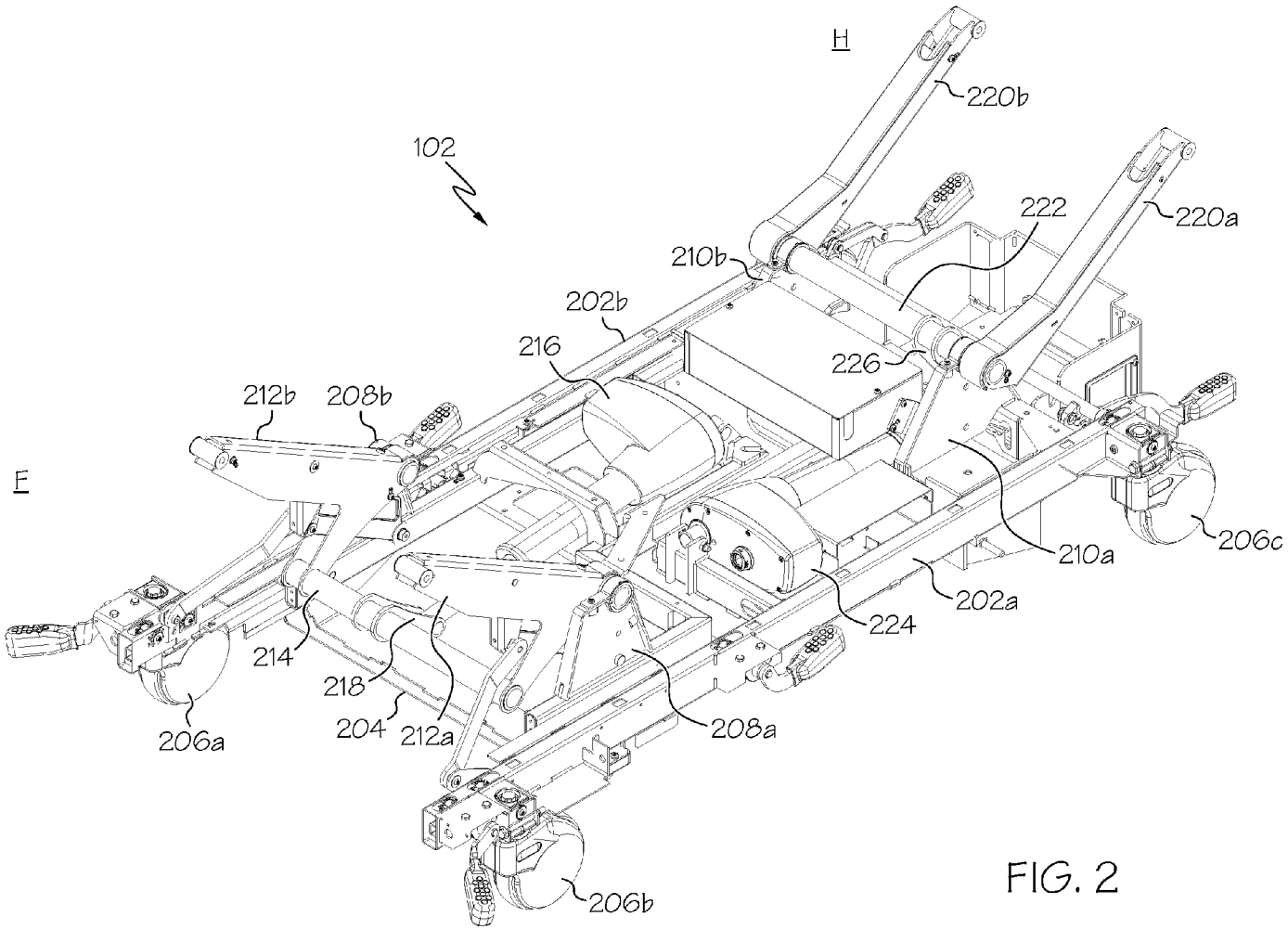
FIG. 2 depicts a perspective view of the base frame of the person support apparatus of FIG. 1A.

Referring now to FIGS. 1B and 2, the base frame 102 contains at least one actuator and corresponding linkages to facilitate raising, lowering, and pivoting/tilting the primary support frame 104 relative to the base frame 102. Tilting the primary support frame 104 such that a head end H of the primary support frame 104 is lower than a foot end F of the primary support frame 104 is referred to as a Trendelenburg orientation. Tilting the primary support frame 104 such that a head end H of the primary support frame 104 is higher than a foot end F of the primary support frame 104 is referred to as a reverse Trendelenburg orientation.

In embodiments, the base frame 102 generally comprises a pair of lateral frame members 202*a*, 202*b* which are joined by a frame pan 204. Lockable caster wheels 206*a*, 206*b*, 206*c* may be pivotally coupled to the lateral frame members 202*a*, 202*b* to facilitate movement of the person support apparatus 100. The base frame 102 may also include a pair foot support brackets 208*a*, 208*b* and a pair of head support brackets 210*a*, 210*b*. The foot support brackets 208*a*, 208*b* are attached to the lateral frame members 202*a*, 202*b* and/or the frame pan 204 proximate to a foot end F of the base frame 102. The head support brackets 210*a*, 210*b* are attached to the lateral frame members 202*a*, 202*b* proximate to a head end H of the base frame 102.

In the embodiments described herein, the base frame 102 further includes a pair of foot linkages 212*a*, 212*b*. The foot linkages 212*a*, 212*b* are pivotally coupled to corresponding foot support brackets 208*a*, 208*b* and to the lower support rail 116 of the primary support frame 104. The foot linkages 212*a*, 212*b* are coupled to one another with foot cross member 214 such that the foot linkages 212*a*, 212*b* synchronously rotate in their respective support brackets 208*a*, 208*b*. A foot end actuator 216 is disposed between the lateral frame members 202*a*, 202*b* and affixed to the frame pan 204 and/or a lateral frame member. In embodiments, the foot end actuator 216 may be a conventional linear actuator. The foot end actuator 216 is coupled to the foot cross member 214 with eccentric link 218. The eccentric link 218 is rigidly attached to the foot cross member 214 and pivotally attached to the foot end actuator 216, such as through a pin and clevis connection, or the like. As the foot end actuator 216 is extended and retracted, the foot cross member 214 is rotated, which, in turn, rotates the foot linkages 212*a*, 212*b* in their respective foot support brackets 208*a*, 208*b*, thereby raising or lowering the foot end F of the primary support frame 104 with respect to the base frame 102.

The base frame 102 further includes a pair of head linkages 220*a*, 220*b*. The head linkages 220*a*, 220*b* are pivotally coupled to corresponding foot support brackets 210*a*, 210*b* and to the primary support frame 104. The head linkages 220*a*, 220*b* are coupled together with head cross member 222 such that the head linkages 220*a*, 220*b* synchronously rotate in their respective support brackets 210*a*, 210. A head end actuator 224 is disposed between the lateral frame members 202*a*, 202*b* and coupled to the frame pan 204 and/or a lateral frame member. In embodiments, the head end actuator 224 may be a conventional linear actuator. The head end actuator 224 is coupled to the head cross member 222 with eccentric link 226. The eccentric link 226 is rigidly attached to the head cross member 222 and pivotally attached to the head end actuator 224, such as through a pin and clevis connection or the like. As the head end actuator 224 is extended and retracted, the head cross member 222 is rotated, which, in turn, rotates the head linkages 220*a*, 220*b* in their respective head support brackets 210*a*, 210*b*, thereby raising or lowering the head end H of the primary support frame 104 with respect to the base frame 102.

Based on the foregoing, it should be understood that the head end actuator 224 and the foot end actuator 216 may be synchronously operated to simultaneously raise the head end H and the foot end F of the primary support frame 104 with respect to the base frame 102. The head end actuator 224 and the foot end actuator 216 may also be independently operated to pivot the primary support frame 104 with respect to the base frame 102, thereby positioning the primary support frame in a Trendelenburg or reverse Trendelenburg orientation.

Figure 3A:
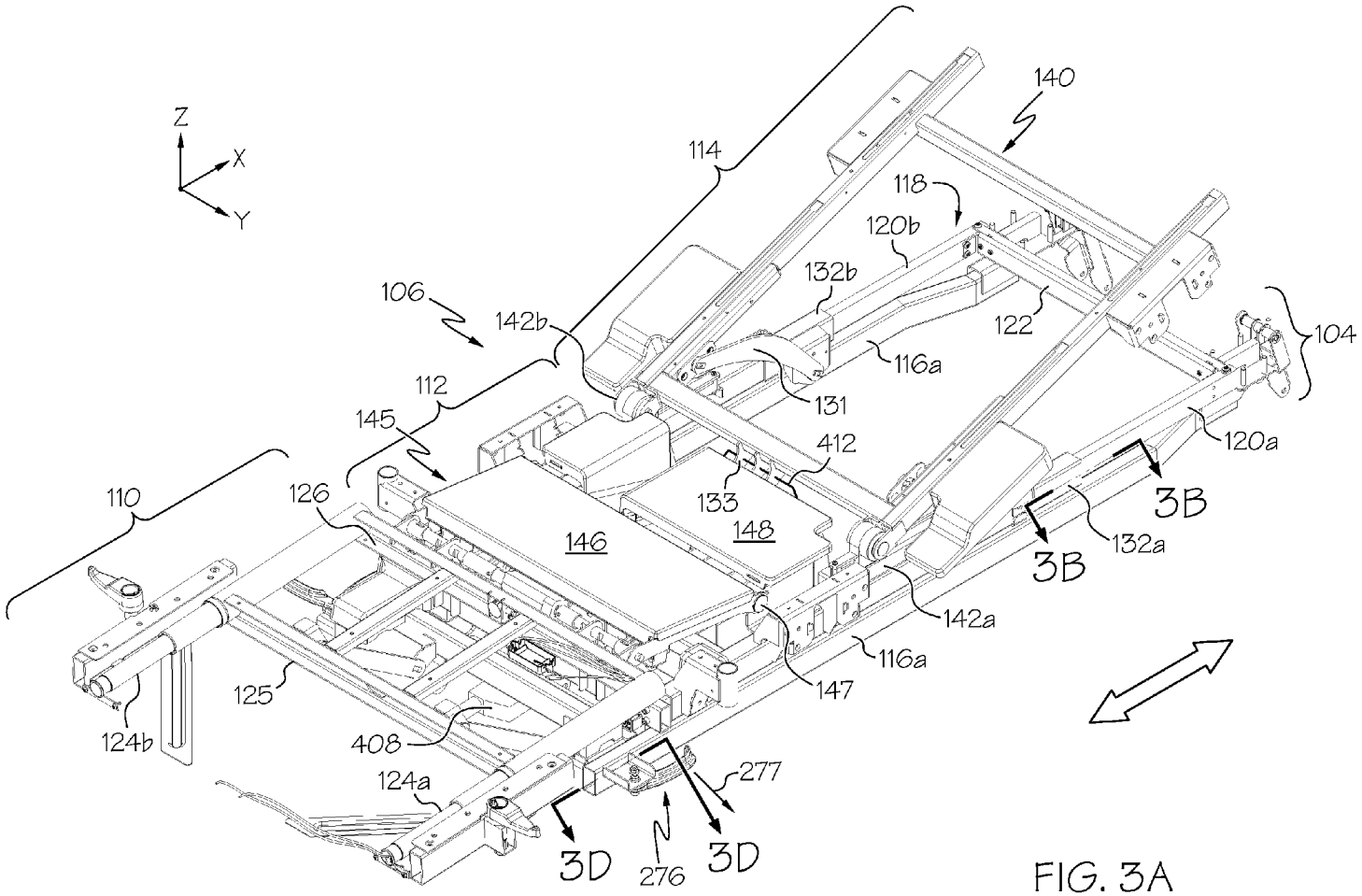
FIG. 3A depicts a perspective view of the primary support frame and carriage of the person support apparatus of FIG. 1A.

Referring now to FIGS. 1B and 3A, in the embodiments described herein the person support apparatus 100 further includes a primary support frame 104 supported on the base frame 102. The primary support frame 104 is pivotally coupled to the foot linkages 212*a*, 212*b* and the head linkages 220*a*, 220*b* of the base frame 102 to facilitate tilting the primary support frame 104 with respect to the base frame 102. The primary support frame 104 generally includes a pair of spaced lower support rails 116*a*, 116*b* and a track frame 118. The track frame 118 is attached to the lower support rails 116*a*, 116*b* and generally includes a pair of spaced upper support rails 120*a*, 120*b* positioned over the lower support rails 116*a*, 116*b*. In embodiments, the track frame 118 may further include at least one cross member 122, which joins the upper support rails 120*a*, 122*b*. The track frame 118 supports the carriage 106 and enables the carriage 106 to translate with respect to the primary support frame 104.

Still referring to FIGS. 1A-1B and 3A, the primary support frame 104 may further include an extendable foot section 110 coupled to the primary support frame 104. The extendable foot section 110 may be pivotally coupled to the primary support frame 104 such that the extendable foot section 110 is pivotable with respect to the primary support frame 104 with the foot section pivot actuator 406 (FIG. 1A). This allows the extendable foot section 110 to be rotated from a substantially horizontal orientation (i.e., the extendable foot section 110 is substantially parallel with the y-x plane of the coordinate axes depicted in FIG. 1B), to at least one declined position where the extendable foot section 110 is non-parallel with the y-x plane of the coordinate axes depicted in FIG. 1B, such that the person support apparatus 100 has a chair-like configuration. In the embodiment of the person support apparatus 100 shown and described herein, the extendable foot section 110 is pivotally coupled to the track frame 118 of the upper support frame. However, it should be understood that the extendable foot section 110 may be, in the alternative, pivotally coupled to the lower support rails 116*a*, 116*b*.

The extendable foot section 110 generally comprises a footboard 130 (FIG. 1B) removably attached to the distal end of the extendable foot section 110 and a pair of telescoping rails 124*a*, 124*b* (FIG. 3A) joined together with cross members 125, 126. An actuator 408 may be coupled between at least one of the cross members 125, 126 and the distal end of the extendable foot section 110 to facilitate extending and retracting the footboard 130 relative to the primary support frame 104. Accordingly, it should be understood that the extendable foot section 110 has an extended position where the extendable foot section is fully extended away from the primary support frame 104, and at least one retracted position, where the extendable foot section 110 is located closer to the primary support frame 104 than when in the extended position. A foot deck 127 (FIG. 1B) may be positioned over the telescoping rails 124*a*, 124*b* to provide support for a support surface positioned on the primary support frame 104.

Figure 3B:
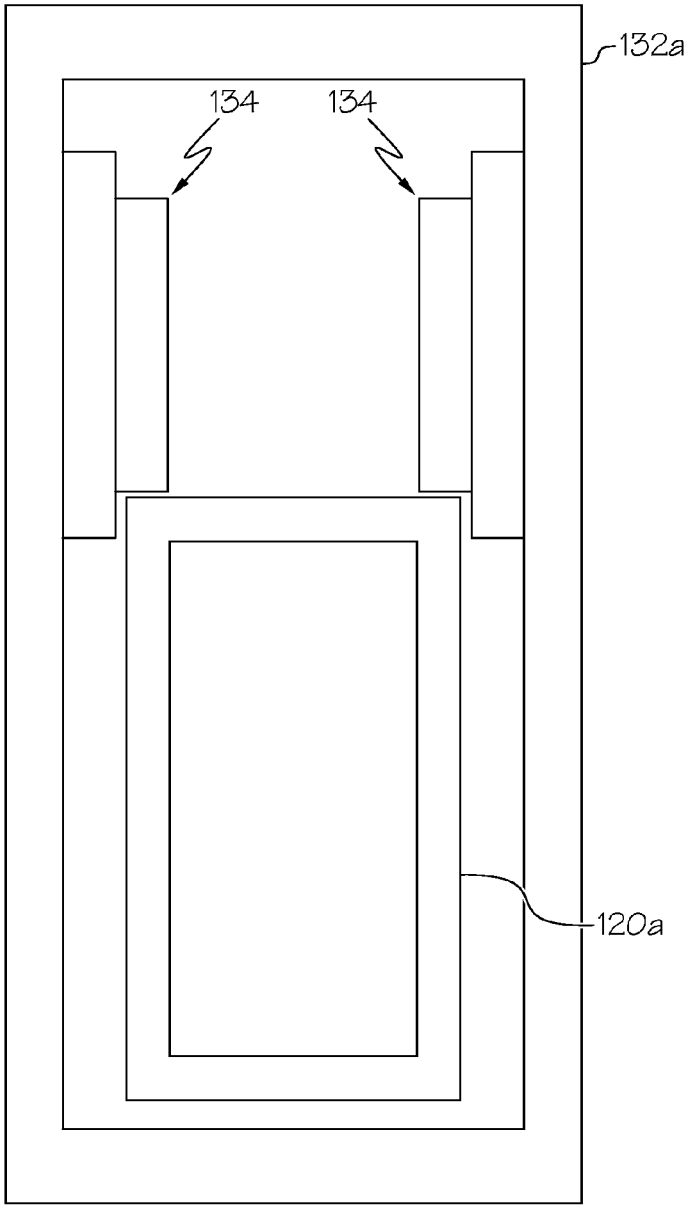
FIG. 3B depicts a cross section of an upper support rail of the primary support frame coupled to a carriage rail of the carriage with bearings according to one or more embodiments shown and described herein.
Figure 3C:
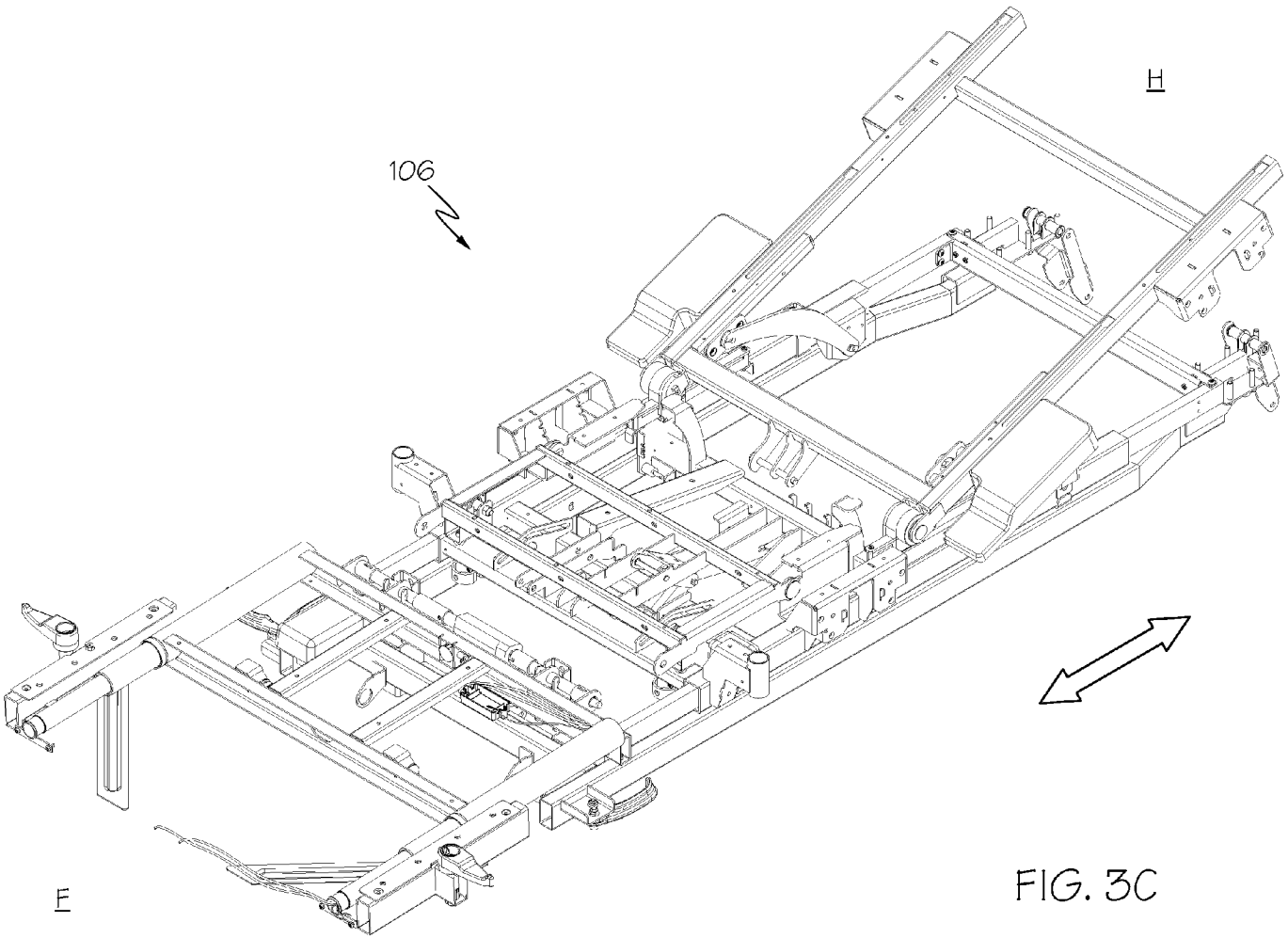
FIG. 3C depicts a perspective view of the primary support frame and carriage with the carriage translated towards a head end of the primary support frame according to one or more embodiments shown and described herein.

Referring now to FIGS. 1B and 3A-3C, the person support apparatus 100 further includes a carriage 106 positioned on the primary support frame 104 such that the carriage 106 is translatable with respect to the primary support frame in the +/−x-direction of the coordinate axes depicted in FIG. 1B. The carriage 106 generally comprises a pair of spaced carriage rails 132*a*, 132*b* slidably coupled to the upper support rails 120*a*, 120*b* of the track frame 118. In the embodiments described herein, each of the carriage rails 132*a*, 132*b* generally has a hollow, rectangular configuration, as depicted in FIG. 3B, with a plurality of bearings 134 positioned within each rail. In the embodiments described herein the bearings 134 are roller bearings. However, it should be understood that, in other embodiment, the bearings 134 may be linear bearings or the like. The upper support rail 120*a* is positioned within the corresponding carriage rail 132*a* such that the upper support rail 120*a* is engaged with the bearings 134 and the carriage rail 132*a* is slidable with respect to the upper support rail 120*a*, thereby facilitating translation of the carriage 106 with respect to the primary support frame 104 between the foot end F of the primary support frame 104 and the head end H of the primary support frame 104, as depicted in FIGS. 3A and 3C.

Figure 3D:
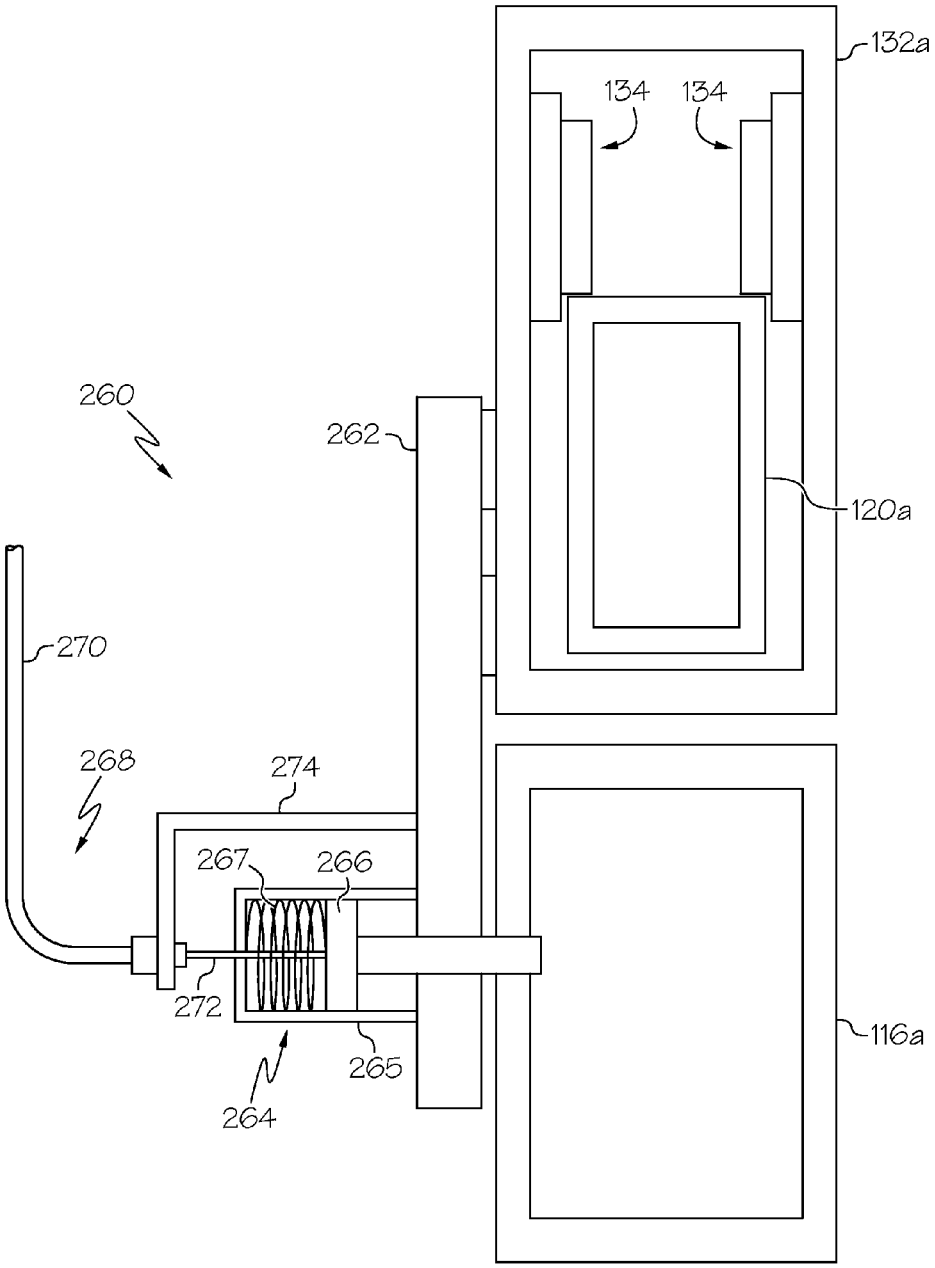
FIG. 3D depicts a cross section of a locking mechanism of the person support apparatus according to one or more embodiments shown and described herein.

Referring now to FIGS. 3A and 3D, in embodiments, the person support apparatus 100 may further comprise a locking mechanism 260 which secures the carriage 106 to the primary support frame 104. In the embodiment depicted in FIG. 3D, the locking mechanism 260 comprises a mounting plate 262 attached to the interior face of the carriage rail 136*a*. At least a portion of the mounting plate 262 extends below the carriage rail 136*a* such that the mounting plate 262 is directly adjacent to an interior face of the lower support rail 116*a*. The mounting plate 262 is slightly offset from the carriage rail 132*a* and the lower support rail 120 such that the carriage rail 132*a* is free to translate with respect to the lower support rail 116*a* without the mounting plate 262 contacting the lower support rail 116*a*.

A locking pin assembly 264 is affixed to the mounting plate 262 and generally includes a housing 265 in which a locking pin 266 is positioned. The locking pin 266 is biased to an extended position with respect to the housing 265 (as shown in FIG. 3D) with a biasing member 267, which, in the embodiment depicted, is a compression spring. The locking pin 266 may be selectively extended from and retracted into the housing 265 by a locking lever 276 (FIG. 3A) pivotally coupled to the lower support rail 116*a* of the primary support frame 104.

Specifically, one end of a cable assembly 268 that includes a central cable 272 slidably disposed in a jacket 270 is coupled to the locking pin 266. The jacket 270 of the cable assembly 268 is retained in a support bracket 274 extending from the mounting plate 262 such that the central cable is free to slide within the jacket 270. The opposite end of the cable assembly 268 is coupled to the locking lever 276 such that actuation of the locking lever 276 slides the central cable 272 within the jacket 270 such that pivoting the locking lever 276 through its range of motion translates the locking pin 266 through its range of motion.

The locking lever 276 has a carriage lock position and a carriage unlock position. When the locking lever 276 is in the carriage lock position, the locking lever 276 is rotated towards the lower support rail 116*a* of the primary support frame 104 decreases the tension on the central cable 272, which, in turn, allows biasing member 267 to bias the locking pin 266 to the extended position. When in the extended position, the locking pin 266 extends through an aperture in the mounting plate 262 and, assuming proper alignment between the carriage 106 and the primary support frame 104, into a corresponding aperture in the lower support rail 116*a* of the primary support frame, thereby coupling the carriage rail 132*a* to the lower support rail 116*a* and preventing translation of the carriage 106 with respect to the primary support frame 104.

When the locking lever 276 is in the carriage unlock position, the locking lever 276 is rotated away from the lower support rail 116*a* of the primary support frame 104 in the direction indicated by arrow 277 in FIG. 3A. This motion tensions the central cable 272 by drawing the central cable 272 with the jacket 270, which, in turn, retracts the locking pin 266 into the housing 265 against the biasing force exerted by the biasing member 267. When the locking pin 266 is retracted into the housing 265, the locking pin 266 is disengaged from the lower support rail 116*a* thereby allowing translation of the carriage 106 with respect to the primary support frame 104.

While the locking mechanism 260 is shown and described herein as being coupled to a locking lever 276 which actuates the locking pin 266, it should be understood that other embodiments are contemplated. For example, in one embodiment, the locking pin 266 may be coupled to an electro-mechanical actuator, such as a solenoid or the like. In this embodiment, the electro-mechanical actuator may be communicatively coupled to the control system 400 (FIG. 7) and may be actuated via the user interface 241 (FIG. 7) to lock and unlock the carriage 106 with respect to the primary support frame 104.

Referring again to FIG. 3A, in the embodiments described herein, the carriage 106 includes a seat portion 112 and a torso portion 114. The seat portion 112 of the carriage 106 generally includes a seat deck 145 coupled to the carriage rails 132*a*, 132*b* such that the seat deck 145 is translatable with the carriage 106. The seat portion 112 includes a gluteal segment 148 and a thigh segment 146. In the embodiments described herein, at least the thigh segment 146 of the seat portion 112 is pivotable with respect to the gluteal segment 148 about pivot point 147. Specifically, the thigh segment 146 may be coupled to the gluteal segment 148 at pivot point 147. A seat pivot actuator 410 (FIG. 1A) may be coupled to the underside of the thigh segment 146 to pivot the thigh segment 146 with respect to the gluteal segment 148 about the pivot point 147. Accordingly, it should be understood that the seat portion 112 of the carriage 106 has at least two configurations: a standard configuration wherein the gluteal segment 148 and the thigh segment 146 are substantially co-planar with one another and a cradle configuration wherein the thigh segment 146 is pivoted towards the gluteal segment 148. The standard configuration of the seat portion is depicted in FIG. 3A. The cradle configuration of the seat portion is depicted in FIG. 1B. Arranging the seat portion 112 of the carriage 106 in the cradle configuration assists in properly positioning a person supported on the seat portion with performing a leg-press type exercise, as will be described in more detail herein.

In the embodiments described herein, the torso portion 114 generally comprises a torso frame 140 which is pivotally coupled to the carriage rails 132*a*, 132*b* with pivots 142*a*, 142*b* such that the torso frame may be pivoted with respect to the seat portion 112. For example, the torso frame may be positioned in a recumbent position (not shown) in which the torso frame is substantially horizontal (i.e., the torso frame is substantially parallel to the x-y plane of the coordinate axes depicted in FIG. 3A) and at least on inclined position, where the torso frame is at an angle with respect to horizontal (i.e., the torso frame 140 is non-parallel to the x-y plane of the coordinate axes depicted in FIG. 3A), as shown in FIG. 3A. A torso actuator 412, such as a linear actuator or the like, is coupled to the primary support frame 104 under the seat portion 112 and pivotally coupled to the torso frame 140 at bracket 133. The torso actuator 412 may be utilized to pivot the torso frame 140 from the recumbent position to the at least one inclined position, and vice-versa. Sliding linkage 131 coupled between the torso frame 140 and the track frame 118 assists in stabilizing the torso frame as it is transitioned from the recumbent position to the at least one inclined position, and vice versa. In the embodiments described herein, the torso portion 114 may further include a torso deck 143 coupled to the torso frame 140. The torso deck 143 may be used to support a support surface, such as a mattress or the like.

Referring now to FIG. 1B, the primary support frame 104 also includes a support deck, which is collectively the foot deck 127, the seat deck 145 (comprised of the thigh segment 146 and the gluteal segment 148), and the torso deck 143. In embodiments, each of the foot deck 127, seat deck 145, and the torso deck 143 may be adjustable/expandable in a widthwise direction of the person support apparatus 100 to accommodate patients of different sizes. For example, each of the foot deck 127, torso deck 143 and the gluteal and thigh segments of the foot deck 127 may be constructed of multiple lateral segments that are each slidably mounted on tracks such that the segments may be expanded or retracted in a widthwise direction of the person support apparatus 100. The various segments of the deck may be articulated with respect to one another to orient the person support apparatus 100 in a bed configuration (i.e., where the foot deck 127, the seat deck 145, and the torso deck 143 are substantially co-planar with one another); a chair configuration (i.e., where the torso deck 143 is inclined with respect to the seat deck 145 and the foot deck 127 is declined with respect to the seat deck 145); and an exercise configuration (i.e., where the torso deck 143 is inclined with respect to the seat deck 145, the foot deck 127 is optionally declined with respect to the seat deck 145, and the seat deck 145 is in the cradle configuration).

Figure 4:
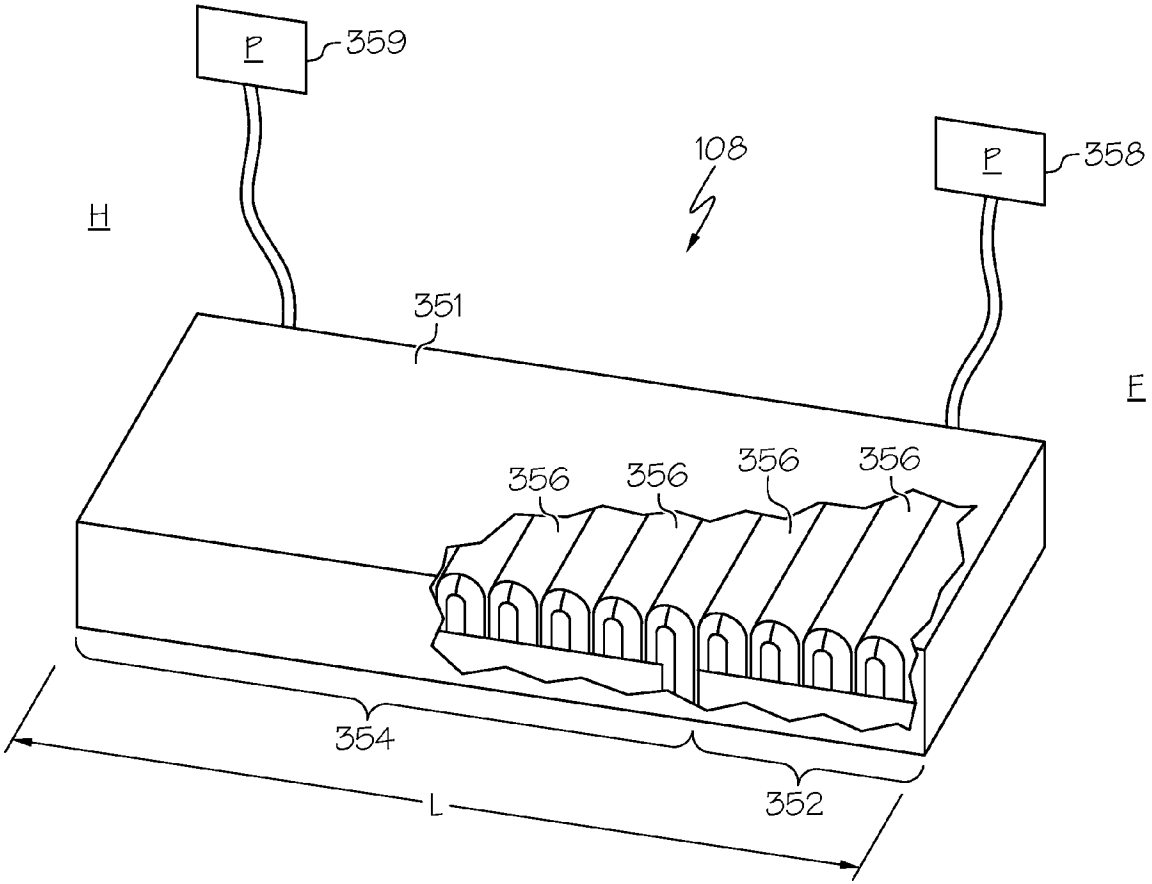
FIG. 4 depicts one embodiment of a support surface with at least one collapsible support section according to one or more embodiments shown and described herein.
Figure 5:
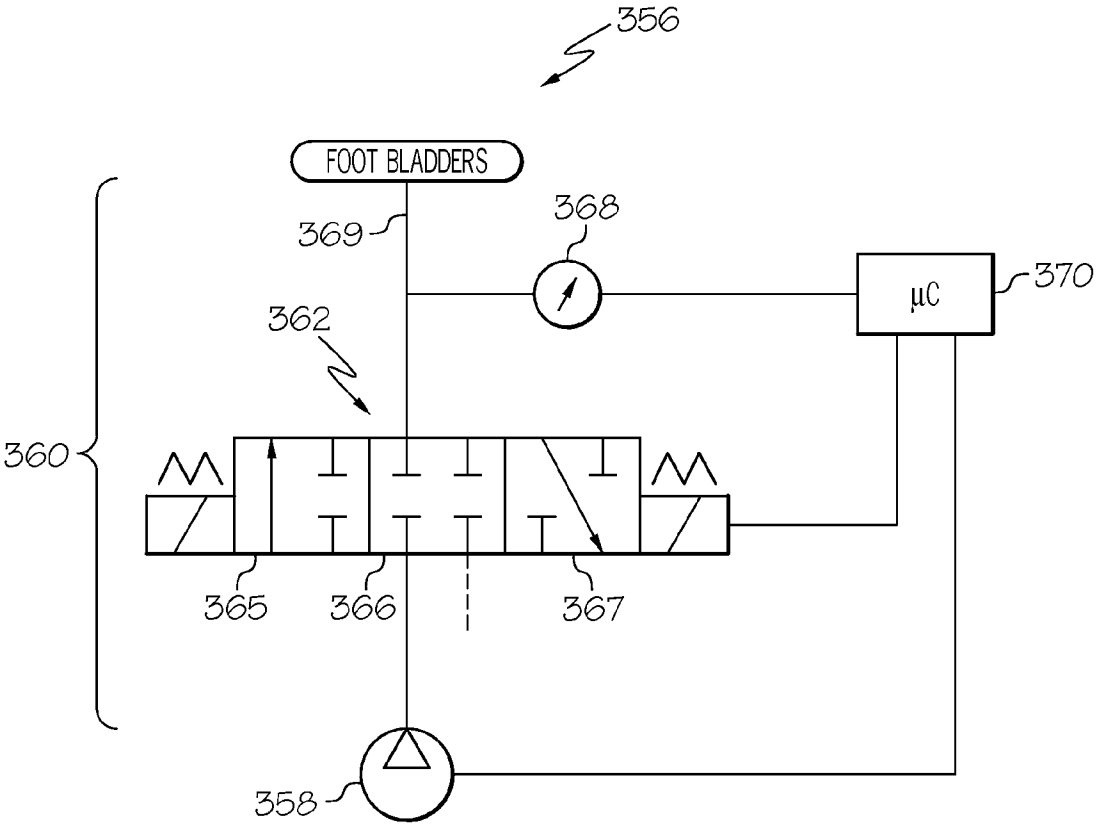
FIG. 5 depicts a pneumatic control circuit coupled to an air bladder of a support surface and a pressure source, according to one or more embodiments shown and described herein.

Referring now to FIGS. 4 and 5, the support surface 108 is schematically depicted. In the embodiments described herein, the support surface 108 is constructed such that at least one support section of the support surface 108 is collapsible in a length direction L of the support surface 108. Inclusion of a collapsible support section in the support surface 108 permits the carriage 106 to translate towards and away from a foot end F of the person support apparatus 100 without having to construct the support surface 108 with removable segments.

For example, in the embodiment of the support surface 108 depicted in FIG. 4, the support surface 108 is constructed from a plurality of air bladders 356 which are positioned in a cover 351. The air bladders 356 may be fluidly coupled to a pressure source 358, 359, such as an air pump, compressor or the like, and corresponding pneumatic control circuitry (FIG. 5) that pressurize the air bladders 356, thereby providing support to a person positioned on the support surface 108. In the embodiments described herein, the air bladders 356 positioned in an upper support section 354 of the support surface 108 are coupled to an upper pressure source 359 while the air bladders 356 positioned in the lower support section 352 are coupled to a lower pressure source 358. Referring to FIG. 5, an exemplary pneumatic control circuit 360 is schematically depicted coupled to the lower pressure source 358. The pneumatic control circuit 360 may include a control valve 362 fluidly coupled to the lower pressure source 358. The pneumatic control circuit 360 may also include a pressure transducer 368, which is fluidly coupled to the air bladders 356. In the embodiment of the pneumatic control circuit 360 depicted in FIG. 5, the pressure transducer 368 is fluidly coupled to a pressure supply line 369 fluidly coupling the control valve 362 to the air bladder 356. The pressure transducer 368, lower pressure source 358, and control valve 362 are communicatively coupled to a microcontroller 370. The pressure transducer 368 measures the pressure within the air bladders 356 and sends an electrical signal indicative of the pressure to the microcontroller 370. When the microcontroller 370 determines that the pressure in the air bladders 356 is low (such as by comparing the measured pressure to a preset pressure or threshold pressure), the microcontroller 370 switches on the lower pressure source 358 and switches the control valve 362 from the normally closed position 366 to the inflate position 365, thereby supplying air to the air bladders 356. When the microcontroller 370 determines that the pressure in the air bladders 356 is high (such as by comparing the measured pressure to a preset pressure or threshold pressure), the microcontroller 370 switches off the lower pressure source 358 (or maintains the lower pressure source 358 in an off state) and switches the control valve 362 from the normally closed position 366 to the vent position 367, thereby venting air from the air bladders 356 and reducing the pressure in the air bladders 356.

In the embodiments described herein, at least one of the air bladders 356 is selectively inflatable and deflatable in order to regulate the amount of travel of the carriage 106 relative to the primary support frame 104.

For example, in one embodiment the support surface 108 includes an upper support section 354 located proximate to the head end H of the support surface 108 and a lower support section 352 located proximate the foot end F of the support surface 108. The air bladders 356 of the upper support section 354 are coupled to a pressure source 359 and corresponding pneumatic control circuitry while the air bladders 356 of the lower support section 352 are coupled to a second, different pressure source 358 and corresponding pneumatic control circuitry. In this embodiment, the air pressure in the air bladders of the lower support section 352 may be controlled independent of the air bladders of the upper support section 354. For example, when the person support apparatus 100 is in an exercise configuration, as described above, the microcontroller 370 of the pneumatic control circuit 360 switches the control valve 362 to the vent position 367 such that the air bladders 356 are vented to atmosphere, thereby allowing the air bladders 356 of the lower support section 352 to be collapsed and compressed in the length direction L as the carriage 106 translates towards the foot end F of the person support apparatus 100.

While the support surface 108 has been described herein as comprising air bladders to facilitate collapsing and compressing a portion of the support surface 108 in the length direction L, it should be understood that other constructs are contemplated. For example, in an alternative embodiment, the upper support section 354 of the support surface 108 may be constructed from a foam material, such as open or closed cell urethane foam, while the lower support section 352 comprises air bladders, as described above. In another embodiment, the entire support surface 108 may be constructed from open or closed cell foam. In this embodiment, the foam in the lower support section may be formed with accordion folds, grooves, and/or ridges to encourage the lower support section to collapse and compress in the length direction L.

In the embodiments of the person support apparatus 100 described herein, the footboard 130 may be used to monitor the physical exercises performed with the person support apparatus 100. For example, the footboard 130 may include one or more force sensors, such as strain gauges or the like, which detect the force applied to the footboard during a physical exercise. These sensors may be used to provide an instantaneous readout of the force applied to the footboard and may also be used to track the force applied to the footboard over time in order to track exercise progress.

Figure 6A:
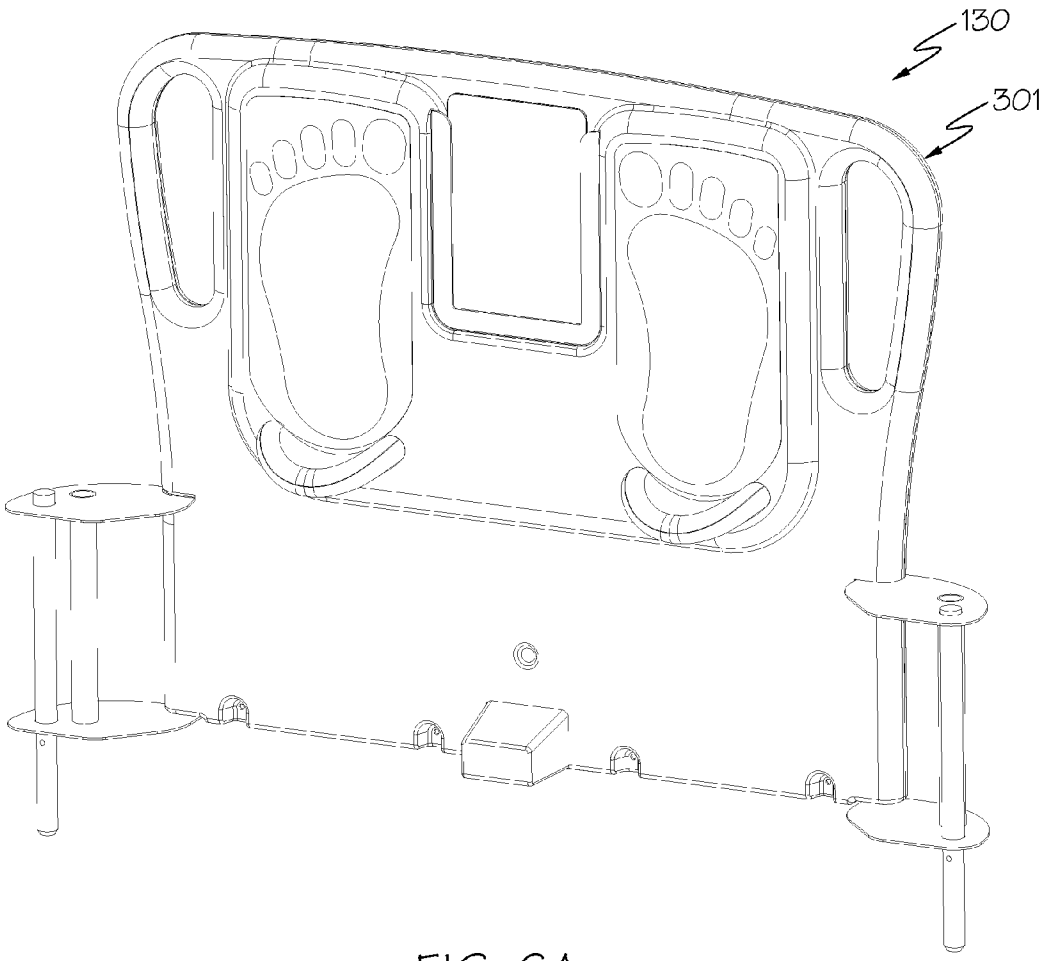
FIG. 6A depicts one embodiment of a footboard for a person support apparatus according to one or more embodiments shown and described herein.
Figure 6B:
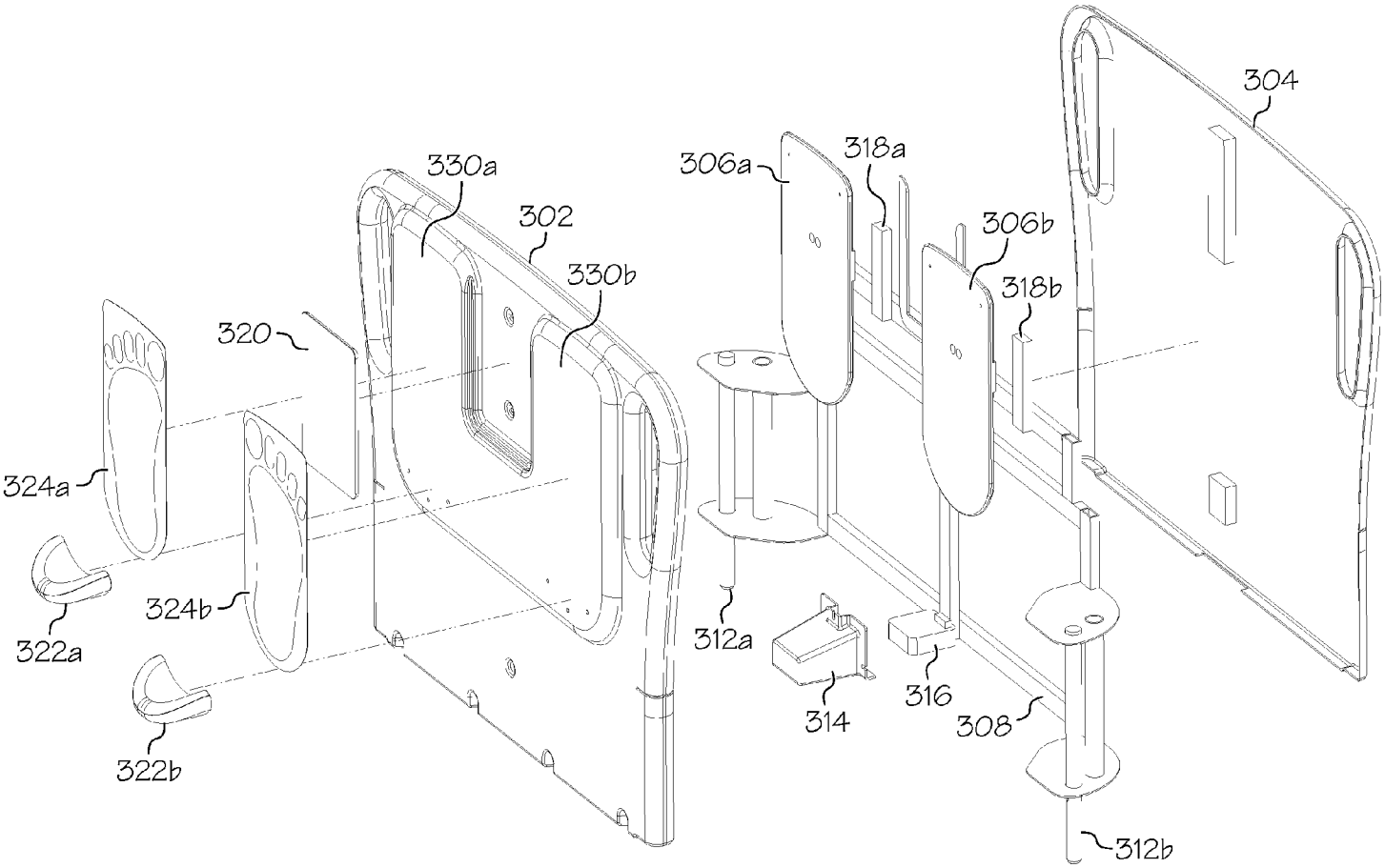
FIG. 6B is an assembly view of the footboard of FIG. 6A.

Referring now to FIGS. 6A and 6B by way of example, one embodiment of a footboard 130 for use with the person support apparatus 100 is depicted. In this embodiment, the footboard 130 generally includes an enclosure 301 comprising a front shell 302 and a back shell 304, which, collectively, enclose an inner frame 308. The footboard 130 also includes locating pins 312*a*, 312*b*, which, in the embodiment of the footboard 130 depicted in FIGS. 6A and 6B, are directly coupled to the inner frame 308. The locating pins 312*a*, 312*b* enable the footboard 130 to be removably coupled proximate to the foot end F of the primary support frame 104 of the person support apparatus 100 (FIG. 1B). For example, in embodiments, the locating pins 312*a*, 312*b* may be received in corresponding apertures formed in the extendable foot section 110 (FIG. 1B). Accordingly, it should be understood that the position of the footboard 130 may be adjustable with respect to the primary support frame 104. Further, in some embodiments, the extendable foot section 110 may contain multiple sets of apertures for receiving the locating pins 312*a*, 312*b* such that the position of the footboard 130 is also adjustable with respect to the extendable foot section 110.

The footboard 130 may also include foot plates (i.e., a left foot plate 306*a* and a right foot plate 306*b*) which are coupled to the inner frame 308. In the embodiments disclosed herein, force sensors 318*a*, 318*b*, such as strain gauges, load cells, or the like, are disposed between the foot plates 306*a*, 306*b* and the inner frame 308 such that force exerted on the foot plates 306*a*, 306*b* is detected by the force sensors 318*a*, 318*b*. For example, in the embodiment of the footboard 130 depicted in FIGS. 6A and 6B, the front shell 302 of the enclosure 301 is formed with recesses 330*a*, 330*b* in which the corresponding foot plates 306*a*, 306*b* are disposed. The force sensors 318*a*, 318*b* are attached to the inner frame 308 such that, when the front shell 302 is coupled to the inner frame 308, the left foot plate 306*a* is in contact with the left force sensor 318*a* and the right foot plate 306*b* is in contact with the right force sensor 318*b*. Accordingly, when force is exerted on the front shell 302 in the area of the left recess 330*a* and/or the right recess 330*b*, the force exerted on the front shell 302 is transmitted to the corresponding force sensor 318*a*, 318*b* through the corresponding foot plate 306*a*, 306*b*. In other embodiments, the footboard may include pads that extend through the front shell 302 and are coupled to the inner frame 308.

In embodiments, the force sensors 318*a*, 318*b* may be Tedea-Huntleigh model 1022 single-point load cells or similar load cells and/or strain gauge sensors. In some embodiments, the force sensors 318*a*, 318*b* may receive power from a wired power source. That is, the force sensors 318*a*, 318*b* may be electrically coupled to a power distribution controller of the person support apparatus 100 which, in turn, may be directly wired to main power using a conventional plug. However, in the embodiment of the footboard 130 depicted in FIGS. 6A and 6B, the force sensors 318 are electrically coupled to a rechargeable battery unit 316 which, in turn, is electrically coupled to an inductive charging unit 314 to facilitate wirelessly charging the rechargeable battery unit 316. Use of the inductive charging unit 314 eliminates the need for a power umbilical between the primary support frame 104 of the person support apparatus 100 and the footboard 130, thereby mitigating the potential for the power umbilical to become snagged and/or disconnected as the extendable foot section 110 is extended and retracted with respect to the primary support frame 104.

As shown in FIGS. 6A and 6B, the footboard 130 may further include foot pads 324*a*, 324*b* positioned on the front shell 302 of the enclosure 301. The foot pads 324*a*, 324*b* are generally located over a corresponding recess 330*a*, 330*b* to assist a user in properly locating his or her feet with respect to the foot plates 306*a*, 306*b* and force sensors 318*a*, 318*b* located within the footboard 130. In embodiments, the foot pads 324*a*, 324*b* may be adhesively coupled to the front shell 302 of the footboard 130 and may include guide indicia to assist a user with proper foot placement on the front shell 302 of the footboard 130. For example, in the embodiment of the footboard 130 depicted in FIGS. 6A and 6B, the guide indicia are outlines of feet which provide a user with an indication of proper foot placement. To enhance traction against the front shell 302 of the footboard 130, the foot pads 324*a*, 324*b* may be formed from a non-slip material such as, for example, non-slip grip tape or the like.

To further assist a user with proper placement of his or her feet with respect to the foot plates 306*a*, 306*b* and force sensors 318*a*, 318*b* located within the footboard 130, the footboard 130 may further include heel cups 322*a*, 322*b*. The heel cups 322*a*, 322*b* are positioned over the corresponding recesses 330*a*, 330*b* in the front shell 302. The heel cups 322*a*, 322*b* align the feet of the user with the corresponding foot plates 306*a*, 306*b* and force sensors 318*a*, 318*b* located within the footboard 130 and also support the feet of the user when proper alignment is obtained.

In the embodiments described herein, the person support apparatus may further include a graphical user interface (GUI) 320. In some embodiments, the GUI 320 may be located on the footboard 130, as depicted in FIGS. 6A and 6B. However, it should be understood that other locations are contemplated. For example and without limitation, in alternative embodiments the GUI 320 may be located along one or more of the side rails coupled to the primary support frame 104. In the embodiments described herein, the GUI 320 and force sensors 318*a*, 318*b* are communicatively coupled to a controller (not shown). The controller receives signals from the force sensors 318*a*, 318*b* indicative of the amount of force applied to the respective foot plates 306*a*, 306*b* and displays related information on the GUI 320. The controller may also include a memory for storing information related to the application of force against the foot plates 306*a*, 306*b* as determined with the force sensors 318*a*, 318*b*. In some embodiments, the GUI 320 may display an instantaneous force applied to each foot plate 306*a*, 306*b* as determined by the force sensors 318*a*, 318*b*. Alternatively or additionally, the GUI 320 may display the instantaneous combined force (left+right) applied to the foot plates 306*a*, 306*b* as determined by the force sensors 318*a*, 318*b*. In some embodiments, the GUI 320 may display an instantaneous comparison of the forces applied to the left and right foot plates 306*a*, 306*b* (e.g., the difference between the force applied to each foot plate). In other embodiments, the controller communicatively coupled to the GUI 320 and the force sensors 318*a*, 318*b*, may record the force applied to the foot plates 306*a*, 306*b* over a specified time duration and display this force as a function of time on the GUI 320. In still other embodiments, the controller may record the force applied to the foot plates 306*a*, 306*b* over time, the relative position of the carriage 106 with respect to the primary support frame 104, and the angle of inclination of the primary support frame 104 with respect to the base frame 102, and display this information of the GUI 320 either instantaneously or as a function of time. In embodiments, the angle of inclination of the primary support frame 104 with respect to the base frame 102 may be determined with an angle sensor (not shown), such as an inclinometer, positioned on the primary support frame 104 and communicatively coupled to the controller 414 (FIG. 7) of the footboard 130 and/or the controller area network 402 of the control system 400. The amount of travel of the carriage 106 relative to the track frame 118 may be determined with a position sensor (not shown), such as a string potentiometer or the like, mounted between the carriage 106 and the track frame 118. The position sensor may be communicatively coupled to the controller 414 (FIG. 7) of the footboard 130 and/or the controller area network 402 of the control system 400 and outputs a signal indicative of the amount of travel of the carriage 106 with respect to the track frame 118. In some embodiments, the controller may also be utilized to calculate the number of exercise reps performed on the person support apparatus.

For example, in some embodiments, the controller in the footboard 130 may utilize the signal received from the position sensor and an internal clock to determine the position of the carriage 106 over time, determine the direction of travel of the carriage over a time interval, determine changes in the direction of travel of the carriage over the time interval and, based on this information, determine the number of exercise reps performed. In this example, a single exercise rep in one direction may be indicated by a change in direction of travel of the carriage 106 after traveling a predetermined distance on the track frame 118. In some embodiments the controller may further calculate the "work" performed by a user as a function of the force applied to the foot plates 306*a*, 306*b*, the length of travel of the carriage 106, the angle of inclination of the primary support frame 104 with respect to the base frame 102, and the total time an exercise is performed. For example, the amount of work performed may be calculated by multiplying the force exerted on the foot plates 306*a*, 306*b* by the amount of travel of the carriage as determined with a position sensor, as described above, over a specified time interval. This information (i.e., time, number of reps, amount of work, applied force, etc.) may be displayed on the GUI numerically or graphically.

In still other embodiments, the controller communicatively coupled to the GUI 320 and the force sensors 318*a*, 318*b* may store information related to the force applied to the foot plates 306*a*, 306*b* for subsequent analysis and evaluation. For example, in some embodiments the controller may instantaneously display the force applied to the foot plates 306*a*, 306*b* while simultaneously recording this information as a function of time for later analysis and evaluation. In this embodiment, the GUI 320 may have an analysis function which allows a user to recall historical data and display this data for further analysis and evaluation. The analysis function may allow a user to manipulate the stored data to determine the total amount of work performed over a time interval, the number of repetitions of an exercise performed over a time interval, and/or similar information.

In some embodiments, the GUI 320 may include a user interface, such as a touch screen or the like, which allows a user to input information into the GUI 320. For example, in some embodiments, the controller associated with the GUI 320 may have a target function that allows a user to input exercise targets and related information. During actual exercise, the GUI 320 may simultaneously display the target information in conjunction with instantaneously collected data to provide a user with a visual indication of whether the user is meeting his target objectives.

In embodiments, the controller communicatively coupled to the GUI 320 and the force sensors 318*a*, 318*b* may be communicatively coupled to a network or a stand-alone device (such as a smart phone, tablet, or laptop computer) either through a wired connection and/or a wireless connection. Suitable wired communication protocols include USB 2.0 or 3.0 connections. Suitable wireless communications protocols include near field communication protocols such as the Bluetooth® communication protocol or the like and WiFi communications protocols such as, for example, the IEEE 802.11 standards. The data collected during an exercise period may be uploaded to the network while other information related to the use and operation of the person support apparatus may be downloaded to the controller. In addition, alarm and/or error codes related to the use, misuse, and/or overuse of the person support apparatus may also be uploaded to the network. Examples of information downloaded to the controller communicatively coupled to the GUI 320 may include, without limitation, exercise protocols, specific user targets, operational thresholds for the apparatus and/or a specific user, user alarm conditions and the like.

In some embodiments, the GUI 320 may be used to display instructional videos to teach a user how to perform specific exercises on the person support apparatus. The instructional videos may be interactive, requiring a user to correctly perform discrete tasks before moving to the next step and/or stage of the video.

Figure 7:
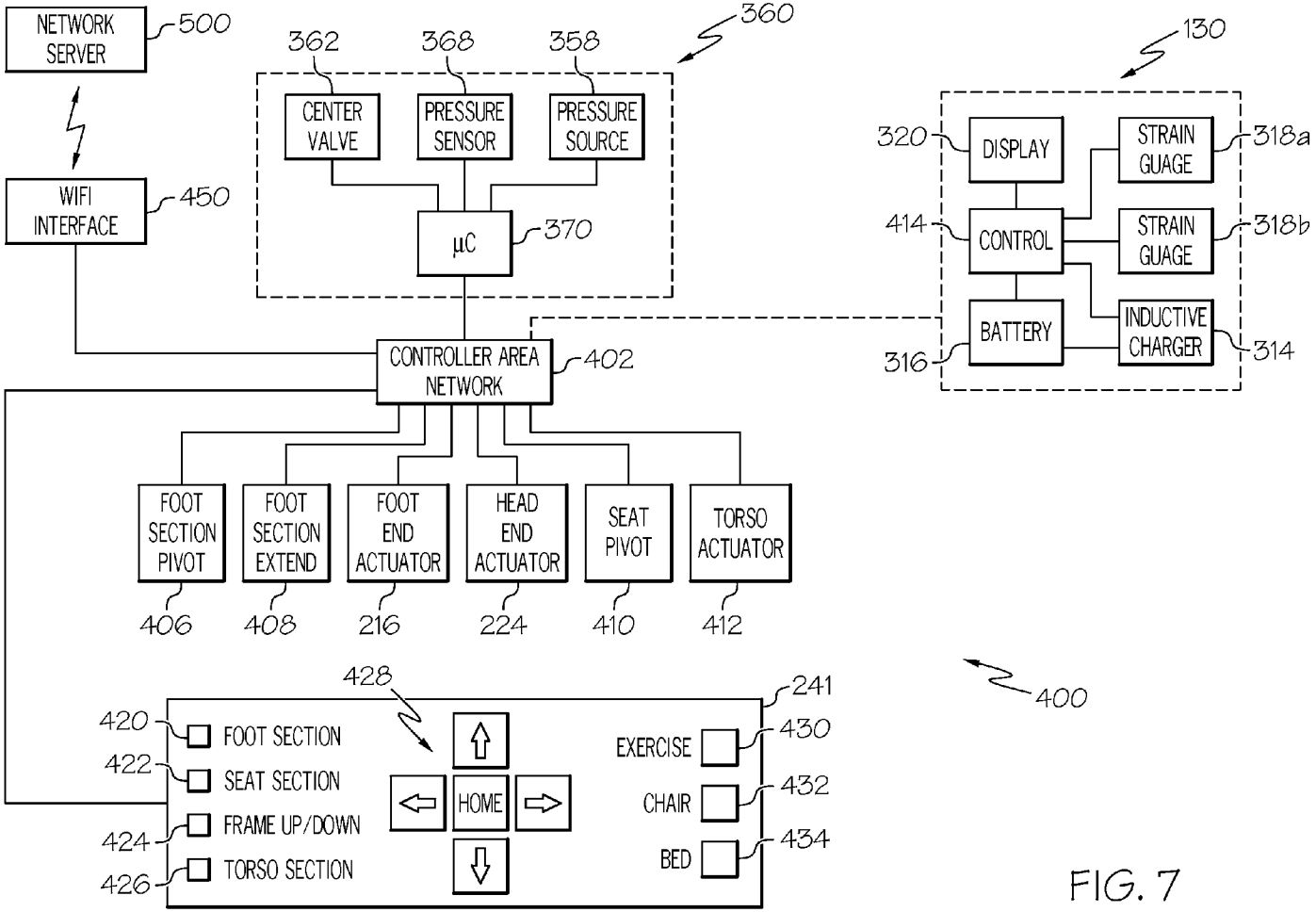
FIG. 7 is a block diagram depicting the interconnectivity of various electrical components of the person support apparatus according to one or more embodiments shown and described herein.

Referring now to FIG. 7, a block diagram of a control system 400 for the person support apparatus 100 is depicted showing the interconnectivity of the various electrical components of the person support apparatus 100. In embodiments, the control system 400 may include a controller area network 402 having a memory storing a computer readable and executable instruction set for controlling the various functions of the person support apparatus 100. The controller area network 402 may also include a processor for executing the computer readable and executable instruction set, sending control signals to the various electrical components of the person support apparatus, and receiving feedback signals from the various electrical components and/or related sensors. In the embodiments described herein, the various components of the control system 400 may be communicatively coupled to the controller area network with wired connections or, alternatively, wirelessly using near-field communication protocols.

Referring now to FIG. 7 and FIGS. 1A-3A, in embodiments, the controller area network 402 is communicatively coupled to the foot end actuator 216 and the head end actuator 224 of the base frame 102 which raise, lower, and tilt the primary support frame 104 relative to the base frame 102. The controller area network 402 is also communicatively coupled to the foot section pivot actuator 406 which pivots the extendable foot section 110 relative to the primary support frame 104 and the foot section extension actuator 408 which extends and retracts the extendable foot section 110 relative to the primary support frame 104 from the extended position to at least one retracted position or vice-versa. The controller area network 402 is also communicatively coupled to the seat pivot actuator 410 which pivots the thigh segment 146 relative to the gluteal segment 148. In addition, the controller area network 402 is communicatively coupled to the torso actuator 412 which pivots the torso frame 140 with respect to the primary support frame 104. Each of these actuators is driven by control signals transmitted to the respective actuators by the controller area network 402.

Referring now to FIG. 7 and FIG. 5, the controller area network 402 is also communicatively coupled to the pneumatic control circuit 360. Specifically, the controller area network 402 may be communicatively coupled to the microcontroller 370 of the pneumatic control circuit 360. Control signals transmitted from the controller area network 402 to the microcontroller 370 may be utilized to instruct the microcontroller 370 to inflate and/or deflate the air bladders of the support surface through actuation of the control valve 362 and/or the pressure source 358. Accordingly, it should be understood that the control signals transmitted from the controller area network 402 to the pneumatic control circuit 360 may be utilized to selectively inflate or deflate the various air bladders contained within the support surface, including, without limitation, selectively inflating and deflating at least one support section of the support surface.

Referring now to FIG. 7 and FIGS. 6A and 6B, the various electrical components of the footboard 130 may also be communicatively coupled to the controller area network 402. For example, the footboard 130 may include a controller 414 that is communicatively coupled to the force sensors 318*a*, 318*b*, GUI 320, battery unit 316, and inductive charging unit 314 of the footboard 130. The controller 414 may include a memory storing computer readable and executable instructions and a processor for executing those instructions. When the instructions are executed by the processor, the controller 414 may be utilized to receive and process signals from the force sensors 318*a*, 318*b* and information related to the duration of exercise, number of repetitions, load/force, etc., and display the processed information on the GUI 320. The controller 414 may also transmit this information to the controller area network 402 for storage and/or further processing, including uploading the received information to a local area network.

Still referring to FIG. 7, the controller area network 402 may be communicatively coupled to one or more user interfaces 241 (one depicted in FIG. 7). The user interfaces 241 may be affixed to the person support apparatus, such as on the side rail 240 as depicted in FIG. 1A. Alternatively or additionally, the user interface 241 may be a stand-alone device (e.g., a wireless remote control). The user interface 241 may include one or more user input devices for controlling the various functions of the person support apparatus 100. For example, in some embodiments, the user interface 241 may comprise a touch screen, a plurality of soft keys, a plurality of mechanical switches, and/or similar input devices. The user interface 241 may include a processor and a memory storing computer readable and executable instructions which, when executed by the processor, receive input signals from the user input devices and transmit the input signals to the controller area network to control the various functions of the person support apparatus.

For example, in the embodiment of the user interface 241 depicted in FIG. 7, the user interface includes a foot section soft key 420 for controlling the foot section pivot actuator 406 and the foot section extension actuator 408, a seat section soft key 422 for controlling the seat pivot actuator 410, a frame up/down soft key 424 for controlling the foot end actuator 216 and the head end actuator 224, and a torso section soft key 426 for controlling the torso actuator 412. Once a soft key corresponding to a specific actuator or actuators is toggled, the user may utilize the directional soft keys 428 to actuate the corresponding actuator or actuators. For example, when the foot section soft key 420 is toggled, the directional soft keys 428 may be utilized to actuate the foot section pivot actuator 406 to pivot the extendable foot section 110 with respect to the primary support frame 104 and/or actuate the foot section extension actuator 408 to extend or retract the extendable foot section 110 with respect to the primary support frame. The "home" key of the directional soft keys 428 may be utilized to drive the corresponding actuators to a pre-set position.

In one embodiment, the user interface 241 may include a plurality of pre-programmed soft keys which may be utilized to orient the person support apparatus 100 in a specific configuration. For example, in the embodiment of the user interface 241 depicted in FIG. 7, the user interface 241 includes an exercise soft key 430, a chair soft key 432, and a bed soft key 434. Toggling the chair soft key 432 will automatically orient the person support apparatus in the chair configuration; toggling the exercise soft key 430 will automatically orient the person support apparatus in the exercise configuration; and toggling the bed soft key 434 will automatically orient the person support apparatus in the bed configuration.

For example, in one embodiment, when the exercise soft key 430 is actuated, the controller area network 402 signals the microcontroller 370 of the pneumatic control circuit 360 to vent the lower support section of the support surface with control valve 362. The controller area network 402 also actuates the foot section extension actuator 408 to retract the extendable foot section towards the primary support frame thereby positioning the extendable foot section in at least one retracted position. Additionally, the controller area network 402 also actuates the seat pivot actuator 410 to pivot the thigh segment towards the gluteal segment and actuates the torso actuator 412 to pivot the torso support frame with respect to the primary support frame.

Still referring to FIG. 7, in some embodiments, the control system 400 further comprises a WiFi interface 450 communicatively coupled to the controller area network 402. The WiFi interface 450 enables the controller area network 402 to transmit data from the control system 400 to an external network, such as network server 500. The WiFi interface 450 also enables the controller area network 402 to receive data from external networks, such as network server 500.

Figure 8A:
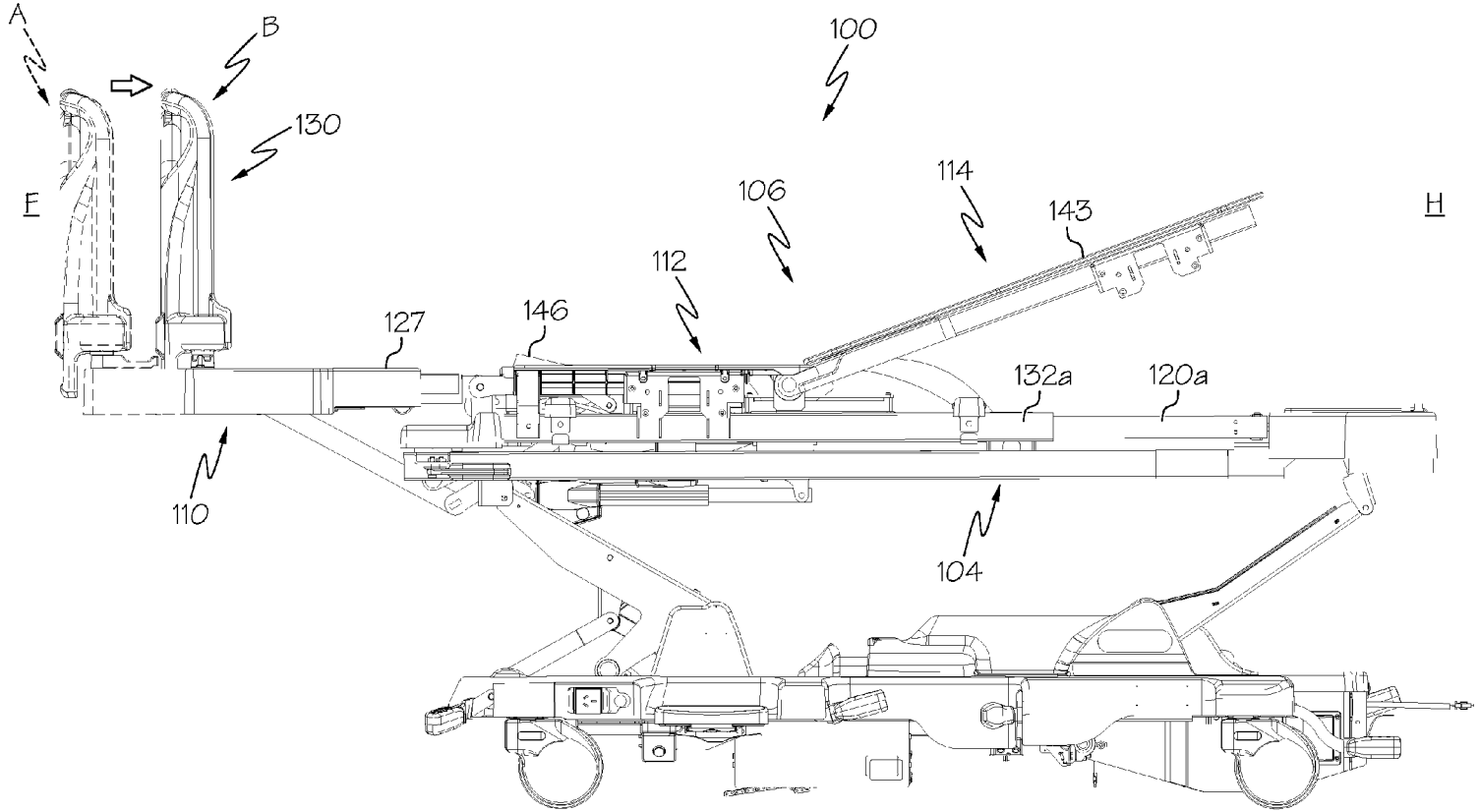
FIG. 8A depicts the person support apparatus in an exercise configuration with the support surface omitted according to one or more embodiments shown and described herein.

Referring now to FIG. 8A, the person support apparatus 100 is depicted in an exercise configuration with the support surface 108 omitted to better illustrate the relative orientation of portions of the person support apparatus 100. When the person support apparatus 100 is in the exercise configuration, the torso portion 114 of the carriage 106 is tilted with respect to the primary support frame 104 at an angle greater than 0 degrees. In the embodiment of the person support apparatus 100 depicted in FIG. 8A, the torso portion 114 of the carriage 106 is tilted at an angle of approximately 45 degrees with respect to the primary support frame 104. However, it should be understood that other angles between the torso portion 114 and the primary support frame 104 are possible, including angles greater than 0 degrees and up to 90 degrees. Tilting the carriage 106 with respect to the primary support frame 104 allows a user seated on the person support apparatus 100 to be properly positioned to perform exercises with the person support apparatus.

Still referring to FIG. 8A, when the person support apparatus 100 is in an exercise configuration, the thigh segment 146 of the seat portion 112 may be pivoted towards the gluteal segment (FIG. 3A) such that the seat portion 112 has a cradle configuration, as described herein. For example and without limitation, in one embodiment the thigh segment 146 may be pivoted at an angle of approximately 6 degrees with respect to the primary support frame 104. However, it should be understood that other angles are contemplated and that the specific angle of pivot may vary depending on the individual. Orienting the seat portion 112 in the cradle configuration raises the upper legs and knees of a user seated on the person support apparatus 100, thereby positioning the user to perform a leg-press type exercise with the person support apparatus 100.

When the person support apparatus 100 is in the exercise configuration, the extendable foot section 110 is translated from an extended position A, where the extendable foot section is extended away from the primary support frame 104, to a retracted position B. Translating the extendable foot section 110 from the extended position A to the retracted position B positions the footboard 130 closer to the carriage 106, thereby enabling a user seated on the carriage 106 to engage his or her feet with the footboard 130 to perform a leg-press type exercise with the person support apparatus 100. It should be understood that an amount by which the extendable foot section is retracted may vary depending on the height of the individual and/or individual preferences.

In some embodiments, when the person support apparatus 100 is in the exercise configuration, the extendable foot section 110 may be substantially parallel with the primary support frame 104. However, in some other embodiments, the extendable foot section 110 may optionally be pivoted downward with respect to the primary support frame 104 when the person support apparatus 100 is in the exercise position. For example and without limitation, the extendable foot section 110 may be downwardly rotated through an angle of up to about 10 degrees (i.e., greater than or equal to about 0 degrees to less than or real to about 10 degrees) from an initial position where the extendable foot section 110 is parallel with the primary support frame 104. However, it should be understood that other angles between the extendable foot section 110 and the primary support frame 104 are possible, including angles greater than or equal to 0 degrees and up to 90 degrees.

Figure 8B:
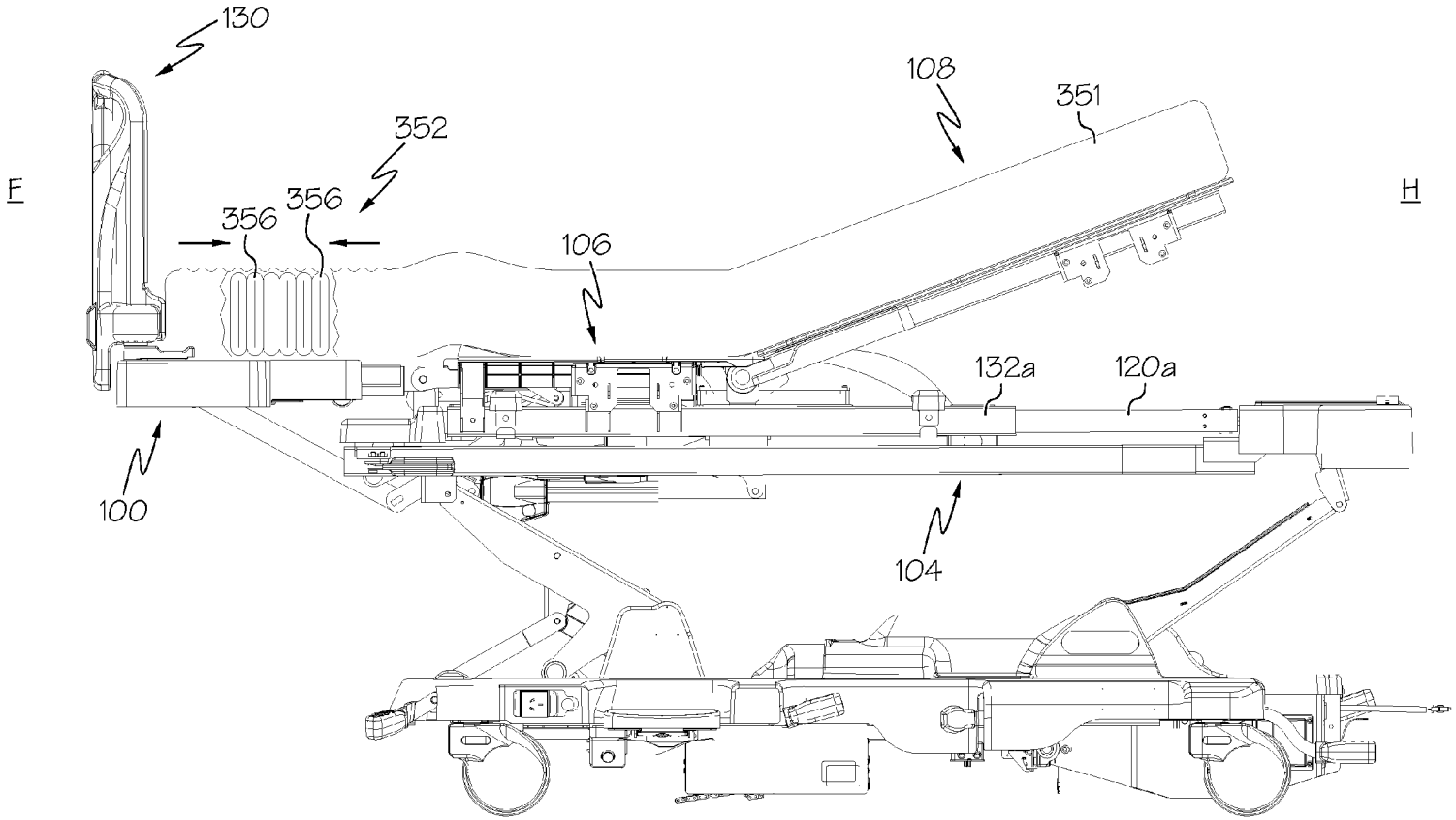
FIG. 8B depicts the person support apparatus and support surface in an exercise configuration with the carriage translated towards the foot end of the person support apparatus according to one or more embodiments shown and described herein.

Referring now to FIGS. 8A and 8B, the person support apparatus 100 is depicted with the support surface 108 positioned on the deck (i.e., the torso deck 143, the seat deck 145 (FIG. 1B), and the foot deck 127) supported on the primary support frame 104. In embodiments, the cover 351 of the support surface 108 may be secured to the deck at the head end H and/or foot end F with tethers, mechanical fasteners, hook and loop fasteners or the like. As described herein, the support surface 108 comprises at least one support section which is collapsible in a length direction of the support surface 108. In the embodiment of the support surface 108 depicted in FIG. 8B, the collapsible support section is a lower support section 352 positioned proximate a foot end F of the support surface 108. In this embodiment, the lower support section 352 comprises a plurality of air bladders 356, as described herein. As the person support apparatus 100 is being oriented in the exercise configuration, as depicted in FIGS. 8A and 8B, the air bladders 356 in the lower support section 352 are vented to atmosphere. In embodiments, the air bladders in the remainder of the support surface 108 are not vented and remain pressurized when the person support apparatus 100 is in the exercise configuration. As the extendable foot section 110 is translated to the retracted position B, the footboard 130 presses against the support surface 108, collapsing the air bladders 356 in a length direction of the support surface 108 as air within the air bladders 356 is vented to atmosphere. This effectively decreases the overall length of the support surface 108 without removing any portions of the support surface 108 from the deck. Collapsing a support section of the support surface 108 also enables positioning the footboard 130 in close proximity to the carriage 106 such that a user seated on the carriage may engage his or her feet with the footboard 130.

Figure 8C:
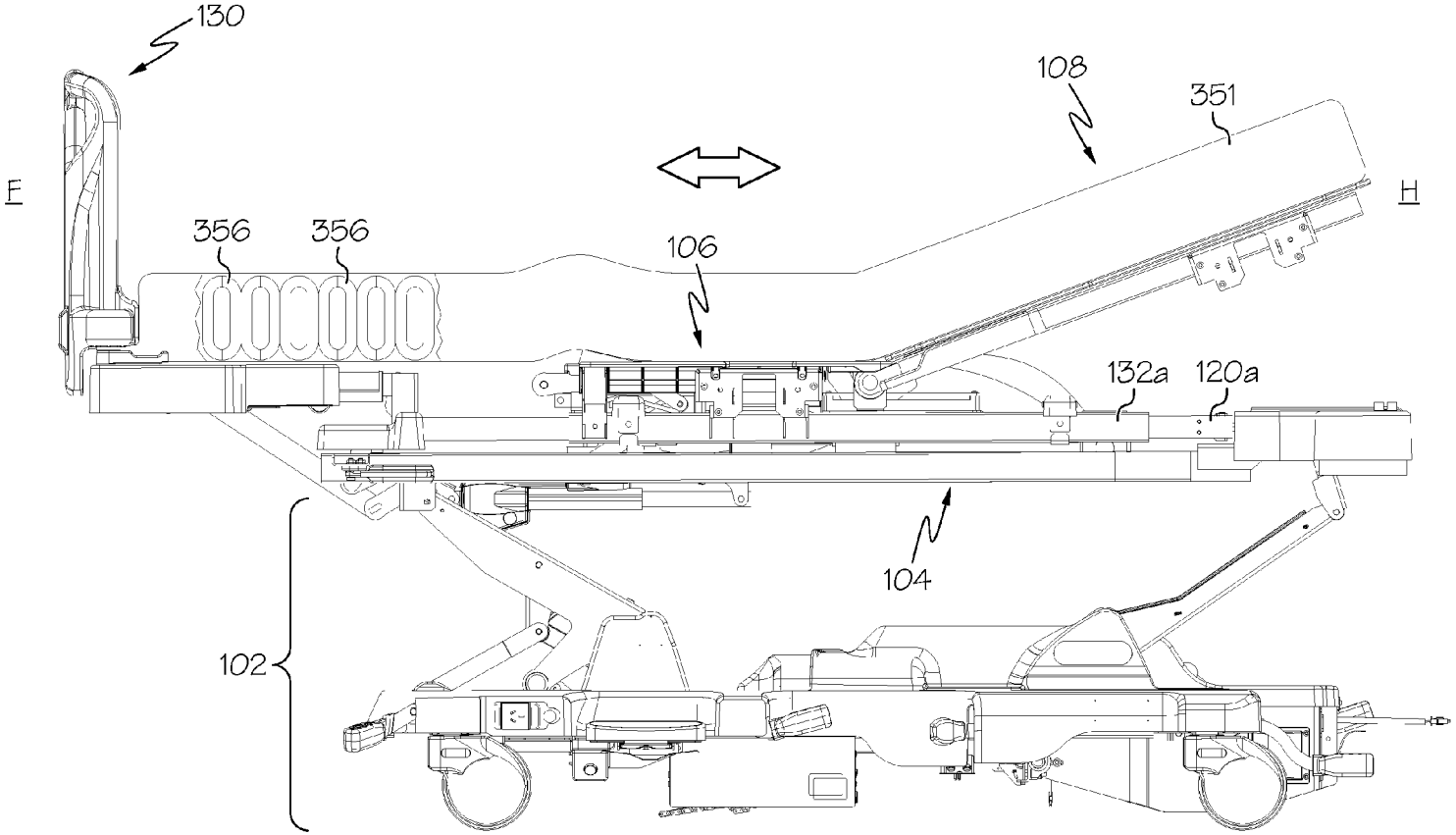
FIG. 8C depicts the person support apparatus and support surface in an exercise configuration with the carriage translated towards the head end of the person support apparatus according to one or more embodiments shown and described herein.

Referring now to FIGS. 8B and 8C, once the person support apparatus 100 is positioned in the exercise configuration, a person seated on the carriage 106 of the person support apparatus 100 may engage his or her feet with the footboard 130. Pressing against the footboard 130 causes the carriage 106 to translate towards the head end H of the person support apparatus 100 with respect to the primary support frame 104. In the embodiment shown in FIGS. 8B and 8C, the carriage rail 132*a* is slidably engaged with the upper support rail 120*a* such that the carriage translates with respect to the upper support rail 120*a* when a user presses against the footboard 130. The translation of the carriage 106 with respect to the primary support frame 104 allows the user to perform a leg-press type exercise.

As the carriage 160 translates towards the head end H of the person support apparatus 100, the air bladders 356, which are vented to atmosphere, may expand which draws air into the air bladder 356. As the carriage 160 translates back towards the foot end F of the person support apparatus 100, the air bladders 356 are once again compressed against the footboard 130. The air drawn into the air bladders 356 during translation of the carriage 106 towards the head end H of the person support apparatus 100 is expelled from the air bladders 356 through the control valve 362 (FIG. 5). The control valve 362 regulates the rate at which air may be expelled from the air bladders 356. As such, the control valve 326 governs the rate at which the air bladders 356 are collapsed and the corresponding rate of travel of the carriage 106 towards the foot end F of the person support apparatus 100.

In some embodiments, when the person support apparatus 100 is in an exercise configuration, the head end H of the primary support frame 104 may be raised above the foot end F of the primary support frame 104 to provide increased resistance to the user performing the leg-press type exercise. Specifically, as the angle between the primary support frame 104 and the base frame 102 is increased, the amount of resistance experienced by the user during performance of the leg-press type exercise increases.

As described hereinabove, in some embodiments, the footboard 130 may be equipped with various sensors, such as force sensors or the like, to determine the force exerted by a user against the footboard 130 as the leg-press type exercise is performed, the number of repetitions, the duration of each repetition, the total duration of exercise, and the like.

Once a user has completed an exercise session, the carriage 106 may be translated towards the foot end F of the person support apparatus 100 and locked in place with the locking mechanism 260 (FIG. 3D) such that the carriage 106 is unable to translate with respect to primary support frame 104. Thereafter, the extendable foot section 110 may be translated towards the extended position A (FIG. 8A) thereby decompressing the air bladders 356. Once the air bladders 356 are decompressed, the control valve 362 (FIG. 5) may be switched to the inflate position and the air bladders 356 inflated to the desired pressure.

It should now be understood that the person support apparatuses described herein includes a base frame, a primary support frame supported on the base frame, and a carriage supported on the primary support frame. The carriage may be translatable/slidable relative to the primary support frame between a head end H and a foot end F of the person support apparatus such that a leg-press type exercise may be performed on the person support apparatus. The person support apparatus may also include a support surface with at least one collapsible support section. The collapsible support section may be collapsed and expanded as the carriage translates relative to the primary support frame, thereby regulating a rate of travel of the carriage with respect to the primary support frame. The collapsible support section also enables leg-press type exercises to be performed on the person support apparatus without removing segments of the support surface.

It will be apparent to those skilled in the art that various modifications and variations can be made to the embodiments described herein without departing from the spirit and scope of the claimed subject matter. Thus it is intended that the specification cover the modifications and variations of the various embodiments described herein provided such modification and variations come within the scope of the appended claims and their equivalents.

What is claimed is:

1. A person support apparatus comprising:

a base frame;

a primary support frame supported on the base frame;

a carriage freely translatable at least between a head end of the primary support frame and a foot end of the primary support frame; and a support surface supported on the carriage such that the support surface translates with the carriage, the support surface comprising at least one support section which is collapsible in a length direction of the support surface, wherein the at least one support section comprises:

an air bladder; and a control valve fluidly coupled to the air bladder that regulates air pressure within the air bladder, the control valve comprising a normally closed position and a vent position, wherein the person support apparatus comprises an exercise configuration wherein the control valve is in the vent position and the air bladder is vented to atmosphere such that air is expelled from the air bladder when the carriage translates toward the foot end of the primary support frame regulating a rate of travel of the carriage with respect to the primary support frame and air is drawn in to the air bladder when the carriage translates toward the head end of the primary support frame.

2. The person support apparatus of claim 1, wherein the at least one support section is a lower support section of the support surface.

3. The person support apparatus of claim 1, wherein:

the carriage comprises seat portion and a torso portion; and the torso portion is inclined with respect to the seat portion when the person support apparatus is in the exercise configuration.

4. The person support apparatus of claim 3, wherein:

the seat portion comprises a thigh segment and a gluteal segment; and the thigh segment is pivoted towards the gluteal segment when the person support apparatus is in the exercise configuration.

5. The person support apparatus of claim 1, further comprising an extendable foot section coupled to the primary support frame, wherein:

the extendable foot section has an extended position and at least one retracted position; and the extendable foot section is in the at least one retracted position when the person support apparatus is in the exercise configuration.

6. The person support apparatus of claim 1, wherein the primary support frame is tiltable with respect to the base frame.

7. The person support apparatus of claim 1 further comprising a deck at least partially supported on the carriage, wherein the support surface is positioned on the deck.

8. The person support apparatus of claim 7, wherein the deck comprises a seat portion and a torso portion, wherein the torso portion is pivotable with respect to the seat portion from a recumbent position to at least one inclined position.

9. The person support apparatus of claim 8, wherein the seat portion comprises a gluteal segment and a thigh segment, wherein at least the thigh segment is pivotable with respect to the gluteal segment.

10. The person support apparatus of claim 9, wherein the person support apparatus has an exercise configuration wherein:

the torso portion is inclined with respect to the seat portion; and the thigh segment is pivoted towards the gluteal segment.

11. The person support apparatus of claim 10, wherein the primary support frame is tilted with respect to the base frame when the person support apparatus is in the exercise configuration.

12. The person support apparatus of claim 10, further comprising an extendable foot section coupled to the primary support frame, wherein:

the extendable foot section has an extended position and at least one retracted position; and the extendable foot section is in the at least one retracted position when the person support apparatus is in the exercise configuration.

13. The person support apparatus of claim 1, further comprising a footboard removably attached proximate to the foot end of the primary support frame.

14. The person support apparatus of claim 13, wherein a position of the footboard is adjustable relative to the primary support frame.

15. The person support apparatus of claim 13, wherein the footboard comprises a left foot plate and a right foot plate, wherein each of the left foot plate and the right foot plate are coupled to corresponding force sensors, the force sensors measuring loads applied to the left foot plate and the right foot plate.

16. The person support apparatus of claim 15, wherein the footboard further comprises a display communicatively coupled to the force sensors with a processor, the display displaying an output of the force sensors.

17. The person support apparatus of claim 15, wherein the footboard further comprises at least one battery electrically coupled to an inductive charging unit.

18. The person support apparatus of claim 1, further comprising a position sensor coupled to the carriage, the position sensor determining an amount of travel of the carriage with respect to the primary support frame.

19. The person support apparatus of claim 1 wherein:

the primary support frame is tiltable with respect to the base frame;

an extendable foot section is pivotally coupled to the primary support frame, the extendable foot section having an extended position and at least one retracted position with respect to the primary support frame; and the at least one support section comprises a lower support section having the air bladder.

20. The person support apparatus of claim 19, wherein the extendable foot section is in the at least one retracted position when the person support apparatus is in the exercise configuration.

21. The person support apparatus of claim 19, wherein the support surface comprises a pressure source fluidly coupled to the at least one air bladder, the pressure source inflating the air bladder.

22. The person support apparatus of claim 19, wherein the support surface further comprises an upper support segment comprising at least one air bladder, wherein the at least one air bladder of the upper support segment is not vented when the person support apparatus is in the exercise configuration.

23. The person support apparatus of claim 19, wherein the primary support frame is tilted with respect to the base frame when the person support apparatus is in the exercise configuration.

24. The person support apparatus of claim 19, further comprising a deck at least partially supported by the carriage, wherein the support surface is positioned on the deck.

25. The person support apparatus of claim 24, wherein the deck comprises a seat portion and a torso portion, wherein the torso portion is pivotable with respect to the seat portion from a recumbent position to at least one inclined position.

26. The person support apparatus of claim 25, wherein the torso portion is inclined with respect to the seat portion and the extendable foot section is in the at least one retracted position when the person support apparatus is in the exercise configuration.

27. The person support apparatus of claim 25, wherein the seat portion comprises a gluteal segment and a thigh segment, wherein at least the thigh segment is pivotable with respect to the gluteal segment.

28. The person support apparatus of claim 27, wherein the thigh segment of the seat portion is pivoted towards the gluteal segment when the person support apparatus is in the exercise configuration.

29. The person support apparatus of claim 19, further comprising a footboard removably attached to the extendable foot section.

30. The person support apparatus of claim 29, wherein a position of the footboard is adjustable relative to the primary support frame.

31. The person support apparatus of claim 29, wherein the footboard comprises a left foot plate and a right foot plate, wherein each of the left foot plate and the right foot plate are coupled to corresponding force sensors, the force sensors measuring loads applied to the left foot plate and the right foot plate.

32. The person support apparatus of claim 31, wherein the footboard further comprises a display communicatively coupled to the force sensors with a processor, the display displaying an output of the force sensors.

33. The person support apparatus of claim 31, wherein the footboard further comprises at least one battery electrically coupled to an inductive charging unit.

34. The person support apparatus of claim 33, further comprising a position sensor coupled to the carriage, the position sensor determining an amount of travel of the carriage with respect to the primary support frame.

* * * * *